US008883703B2

(12) United States Patent
Stenger et al.

(10) Patent No.: US 8,883,703 B2
(45) Date of Patent: Nov. 11, 2014

(54) LAUNDRY DETERGENT COMPOSITION COMPRISING PARTICLES OF PHTHALOCYANINE COMPOUND ENCAPSULATED IN LOW BLOOM GELATINE

(71) Applicant: The Procter & Gamble Company, Cincinnati, OH (US)

(72) Inventors: Patrick Christopher Stenger, Fairfield, OH (US); Gregory Scot Miracle, Liberty Township, OH (US); Andrew Phillip Moon, Tyne & Wear (GB); Michael McDonnell, Northumberland (GB); Stefan Bruhns, Mannheim (DE); Gunther Schlingloff, Muhlhausen (DE); Ulrich Menge, Grenzach (DE); Frank Bachmann, Freiburg (DE); Andreas Lindenmaier, Steinen (DE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 13/870,136

(22) Filed: Apr. 25, 2013

(65) Prior Publication Data

US 2013/0288942 A1 Oct. 31, 2013

Related U.S. Application Data

(60) Provisional application No. 61/639,124, filed on Apr. 27, 2012.

(51) Int. Cl.

| | |
|---|---|
| ***C11D 3/395*** | (2006.01) |
| ***C11D 17/00*** | (2006.01) |
| ***C11D 3/00*** | (2006.01) |
| ***C11D 3/40*** | (2006.01) |

(52) U.S. Cl.

CPC ..... *C11D 17/0039* (2013.01); *C11D 3/0063* (2013.01); *C11D 3/40* (2013.01)

USPC ..... 510/301; 510/276; 510/286; 510/300; 510/311; 510/312; 510/314; 510/307; 510/324; 510/349; 510/376; 510/394; 510/441

(58) Field of Classification Search

USPC ..... 510/276, 286, 300, 301, 307, 311, 312, 510/314, 324, 349, 376, 394, 441

See application file for complete search history.

(56) References Cited

U.S. PATENT DOCUMENTS

| | | | | |
|---|---|---|---|---|
| 4,990,280 | A * | 2/1991 | Thorengaard et al. | 510/301 |
| 6,291,412 | B1 * | 9/2001 | Kvita et al. | 510/301 |
| 7,909,890 | B2 | 3/2011 | Kramer et al. | |
| 8,585,780 | B2 * | 11/2013 | Araya Hernandez et al. | 8/442 |
| 2006/0165990 | A1 * | 7/2006 | Curtis et al. | 428/402.2 |
| 2013/0261042 | A1 * | 10/2013 | Stenger et al. | 510/299 |

OTHER PUBLICATIONS

PCT Sreach Report, PCT/US2013/036922, dated Jul. 5, 2013, containing 9 pages.

* cited by examiner

*Primary Examiner* — Charles Boyer

(74) *Attorney, Agent, or Firm* — John T. Dipre; Steven W. Miller

(57) ABSTRACT

The present invention relates to encapsulated phthalocyanine particles, to a process for the preparation thereof, compositions comprising such particles and washing agent formulations.

The encapsulated phthalocyanine particles comprise a) at least one water-soluble phthalocyanine compound, and b) gelatine having a bloom strength of 2 to 80 as encapsulating material.

20 Claims, No Drawings

LAUNDRY DETERGENT COMPOSITION COMPRISING PARTICLES OF PHTHALOCYANINE COMPOUND ENCAPSULATED IN LOW BLOOM GELATINE

FIELD OF THE INVENTION

The present invention relates to compositions comprising granules of phthalocyanine compounds.

BACKGROUND OF THE INVENTION

Water-soluble phthalocyanine complex compounds especially zinc and aluminium phthalocyanine sulphonates are frequently used as photo-activators in washing agent preparations.

A problem is seen in the fact that such photo-activators, despite their water-solubility, dissolve too slowly in water. Especially, in the event of inadequate mixing of the washing liquor, coloured photo-activators tend to stain the laundry.

It has now been found that the rate at which formulations of such phthalocyanines, particularly encapsulated phthalocyanines, dissolve in water can be improved by the use of gelatine with higher bloom strength as encapsulating material.

Therefore, the present invention relates to encapsulated phthalocyanine particles comprising a) at least one water-soluble phthalocyanine compound, and b) gelatine having a bloom strength of 2 to 80 as encapsulating material.

SUMMARY OF THE INVENTION

The present invention relates to a laundry detergent composition comprising encapsulated phthalocyanine particles, said particles comprising (a) at least one water-soluble phthalocyanine compound, and (b) gelatine having a bloom strength of 2 to 80 as encapsulating material.

DETAILED DESCRIPTION OF THE INVENTION

Phthalocyanine Compound

Suitable phthalocyanine compounds are water-soluble or at least water-dispersible phthalocyanine complex compounds with di-, tri- or tetra-valent coordination centres, particularly metal ions (complexes having a $d^0$ or $d^{10}$ configuration), as the central atom, to which the substituent of at least one mono-azo dye is attached.

Such phthalocyanine complex compounds correspond to the formula (PC)-L-(D) (1), to which the substituent of at least one mono-azo dye is attached by the linking group L, Wherein PC represents the Zn(II), Fe(II), Ca(II), Mg(II), Na(I), K(I), Al(III), Si(IV), P(V), Ti(IV) or Cr(VI) metal-containing phthalocyanine structure;

D represents the substituent of a mono-azo dye; and

L represents a group

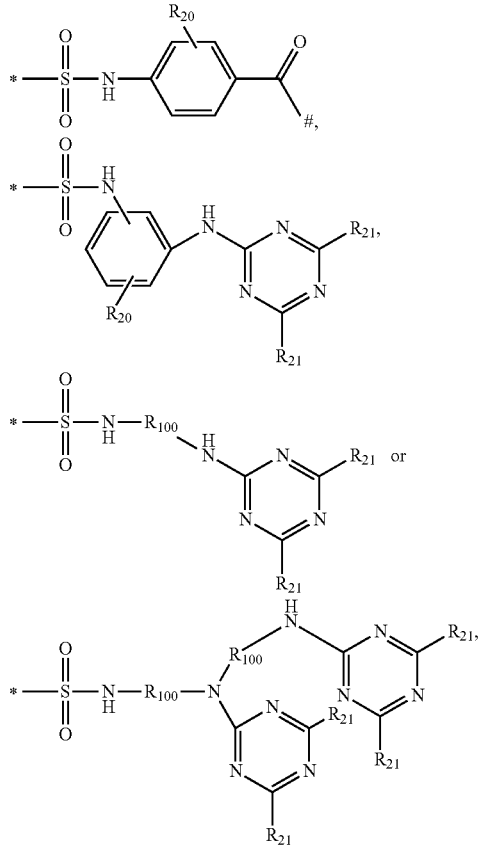

Wherein $R_{20}$ represents hydrogen, $C_1$-$C_8$alkyl, $C_1$-$C_8$alkoxy or halogen;

$R_{21}$ represents D, hydrogen, OH, Cl or F, provided that at least one of $R_{21}$ is D;

$R_{100}$ represents $C_1$-$C_8$alkylene;

* marks the point of attachment of PC; and # marks the point of attachment of the substituent D of the mono-azo dye.

$C_1$-$C_8$alkyl is linear or branched alkyl, for example methyl, ethyl, propyl, butyl, pentyl, hexyl, heptyl, octyl or isopropyl.

$C_1$-$C_8$alkoxy is linear or branched, for example methoxy, propoxy or octyloxy.

Halogen is F, Cl, Br or I, preferably Cl.

$C_1$-$C_8$alkylene is, for example, linear or branched methylene, ethylene, propylene, butylene or pentylene.

The phthalocyanine complex compound of the formula (1), wherein the phthalocyanine backbone is substituted by at least one sulpho groups and to which the substituent of at least one mono-azo dye is attached by the linking group L, are characterized by rapid photo degradation, which has the effect that discolouration on the treated fabric is avoided, even after repeated treatment. The phthalocyanine complex compounds of the formula (1) are characterized by improved shading and exhaustion onto the fabrics. The phthalocyanine complex compounds of the formula (1) are also highly efficient photo catalysts by additional light absorption and energy transfer to the phthalocyanine part of the molecule According to a preferred embodiment the water-soluble phthalocyanine complex compound (1) corresponds to the formula (1a)

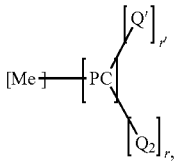

Wherein

PC represents the phthalocyanine structure;

Me represents the central metal atom or central metal group coordinated to PC, which is selected from the group consisting of Zn, Fe, Ca, Mg, Na, K, Al—$Z_1$, Si(IV)-$(Z_1)_2$, Ti(IV)-$(Z_1)_2$ and Sn(IV)-$(Z_1)_2$;

$Z_1$ represents $C_1$-$C_8$alkanolate, $OH^-$, $R_0COO_-$, $ClO_4^-$, $BF_4^-$, $PF_6^-$, $R_0SO_3^-$, $SO_4^{2-}$, $NO_3^-$, $F^-$, $Cl^-$, $Br^-$, $I^-$, citrate, tartrate or oxalate, wherein $R_0$ is hydrogen or $C_1$-$C_{18}$alkyl;

r represents 0 or a numeral from 1 to 3, preferably 1 to 2;

r' represents a numeral from 1 to 3, preferably 1 to 3;

each $Q_2$ independently of one another represents —$SO_3^-M^+$ or the group —$(CH_2)_m$—$COO^-$ $M^+$; wherein $M^+$ is $H^+$, an alkali metal ion or the ammonium ion and m is 0 or a numeral from 1 to 12;

each Q' independently of one another represents the segment of the partial formula -L-D, Wherein D represents the substituent of a mono-azo dye; and L represents a group

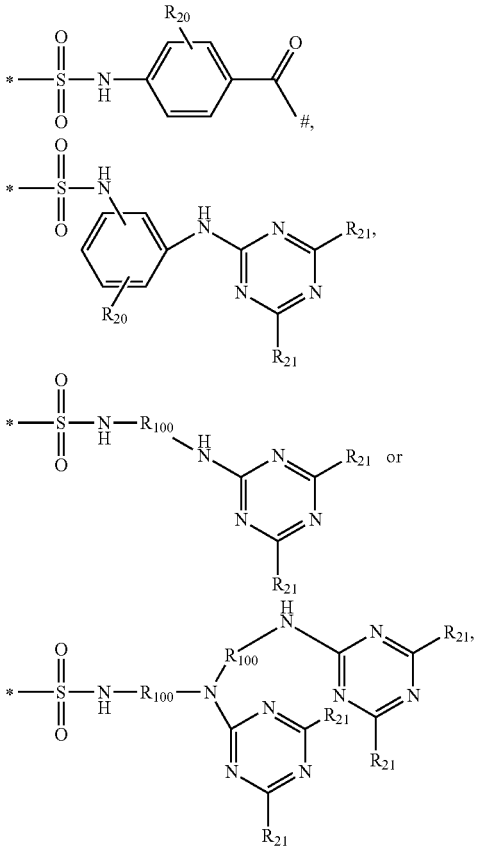

Wherein $R_{20}$ represents hydrogen, $C_1$-$C_8$alkyl, $C_1$-$C_8$alkoxy or halogen;

$R_{21}$ represents D, hydrogen, OH, Cl or F, provided that at least one is D;

$R_{100}$ represents $C_1$-$C_8$alkylene;

* marks the point of attachment of Me-PC; and # marks the point of attachment of the substituent D of the mono-azo dye.

In the phthalocyanine complex compound that corresponds to the formula (1a) of above, the sum of r and r' is preferably from 1-4.

Me represents the central metal atom or central metal group coordinated to PC, which is selected from the group consisting of Zn, Al—$Z_1$ and Ti(IV)-$(Z_1)_2$, wherein $Z_1$ is as defined above, preferably halogen, e.g. chlorine, or hydroxy.

Me preferably represents Zn.

According to a preferred embodiment the water-soluble phthalocyanine complex compound (1) corresponds to the formula (2a)

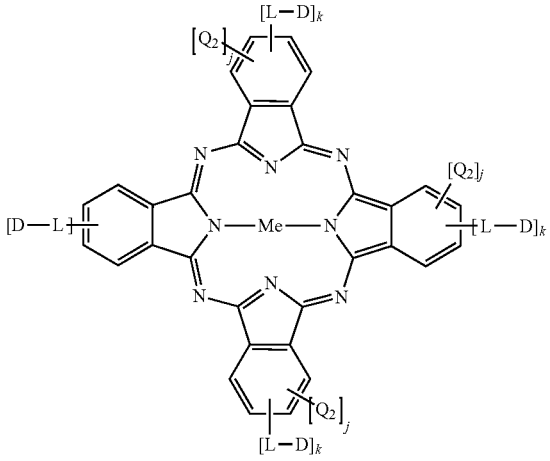

wherein

Me represents Zn, Al—$Z_1$, Si(IV)-$(Z_1)_2$ or Ti(IV)-$(Z_1)_2$, wherein $Z_1$ is chloride, fluoride, bromide or hydroxide;

each $Q_2$ independently of one another represents —$SO_3^-M^+$ or the group —$(CH_2)_m$—$COO^-M^+$, wherein $M^+$ is $H^+$, an alkali metal ion or the ammonium ion and m is 0 or a numeral from 1 to 12;

each k is independently selected from 0 and 1, each j is independently selected from 0 and 1-k, D represents the substituent of a mono-azo dye; and L represents a group

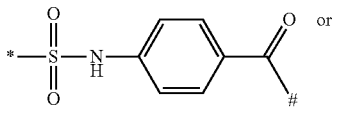

-continued

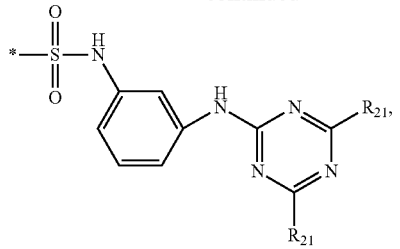

wherein $R_{21}$ represents D, hydrogen, OH, Cl or F, provided that at least one of $R_{21}$ is D, preferably two of $R_{21}$ are D;

* marks the point of attachment of PC; and # marks the point of attachment to D.

For the 1-k in the definition of the number j, the number k shall refer to the substituent -[L-D]k which is attached to the same 6-membered aromatic ring as the respective substituent -[Q2]j.

According to a preferred embodiment, the groups D, independently of one another, represent the substituents of a mono-azo dye of the partial formulae Xa, Xb, Xc or Xd:

(Xa)

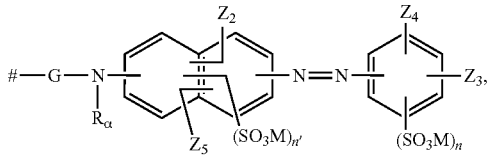

(Xb)

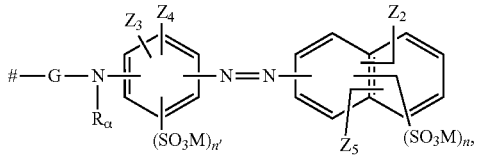

(Xc)

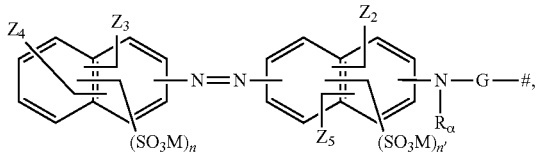

(Xd)

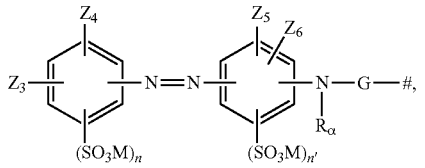

wherein # marks the point of attachment of the bridging group L;

$R_\alpha$ represents hydrogen, $C_1$-$C_4$alkyl, $C_1$-$C_2$alkyl which is substituted by at least one substituent selected from the group consisting of hydroxy, cyano, $SO_3H$, $NH_2$, carboxy, carbo-$C_1$-$C_4$alkoxy, $C_1$-$C_4$alkoxy, phenyl, naphthyl and pyridyl, straight chain or branched $C_3$-$C_4$-alkyl which is substituted by at least one substituent selected from the group consisting of hydroxy, cyano, $SO_3H$, $NH_2$, carboxy, carbo-$C_1$-$C_4$alkoxy, $C_1$-$C_4$alkoxy, phenyl, naphthyl and pyridyl, aryl, aryl which is substituted by at least one substituent selected from the group consisting of hydroxy, cyano, $SO_3H$, $NH_2$, carboxy, carbo-$C_1$-$C_4$alkoxy, $C_1$-$C_4$alkoxy and $C_1$-$C_4$alkyl;

$Z_2$, $Z_3$, $Z_4$, $Z_5$ and $Z_6$ independently of one another represent hydrogen, hydroxy, $C_1$-$C_4$alkyl, $C_1$-$C_2$alkyl which is substituted by at least one substituent selected from the group consisting of hydroxy, cyano, $SO_3H$, $NH_2$, carboxy, carbo-$C_1$-$C_4$alkoxy, $C_1$-$C_4$alkoxy, phenyl, naphthyl and pyridyl, straight chain or branched $C_3$-$C_4$-alkyl which is substituted by at least one substituent selected from the group consisting of hydroxy, cyano, $SO_3H$, $NH_2$, carboxy, carbo-$C_1$-$C_4$alkoxy, $C_1$-$C_4$alkoxy, phenyl, naphthyl and pyridyl, $C_1$-$C_4$alkoxy, $C_1$-$C_2$alkoxy which is substituted by at least one substituent selected from the group consisting of hydroxy, cyano, $SO_3H$, $NH_2$, carboxy, carbo-$C_1$-$C_4$alkoxy, $C_1$-$C_4$alkoxy, phenyl, naphthyl and pyridyl, straight chain or branched $C_3$-$C_4$alkoxy which is substituted by at least one substituent selected from the group consisting of hydroxy, cyano, $SO_3H$, $NH_2$, carboxy, carbo-$C_1$-$C_4$alkoxy, $C_1$-$C_4$alkoxy, phenyl, naphthyl and pyridyl, halogen, —$SO_2CH_2CH_2SO_3H$, $NO_2$, COOH, —$COOC_1$-$C_4$alkyl, $NH_2$, $NHC_1$-$C_4$alkyl, wherein the alkyl group may be substituted by at least one substituent selected from the group consisting of OH, $NH_2$, $C_1$-$C_4$alkyl, CN and COOH, $N(C_1$-$C_4$alkyl)$C_1$-$C_4$alkyl, wherein the alkyl groups may independently of one another be substituted by at least one substituent selected from the group consisting of OH, $NH_2$, $C_1$-$C_4$alkyl, CN and COOH, NH-aryl, NH-aryl, wherein aryl is substituted by at least one substituent selected from the group consisting of hydroxy, cyano, $SO_3H$, $NH_2$, carboxy, carbo-$C_1$-$C_4$alkoxy, $C_1$-$C_4$alkyl and $C_1$-$C_4$alkoxy, or represents $NHCOC_1$-$C_4$alkyl or $NHCOOC_1$-$C_4$alkyl;

G represents the direct bond, —$COOC_1$-$C_4$alkylene, arylene; arylene which is substituted by at least one substituent selected from the group consisting of hydroxy, cyano, $NO_2$, $SO_3H$, $NH_2$, carboxy, carbo-$C_1$-$C_4$alkoxy, $C_1$-$C_4$alkoxy and $C_1$-$C_4$alkyl, $C_1$-$C_4$alkylene, $C_1$-$C_4$-alkylene substituted by at least one substituent selected from the group consisting of hydroxy, cyano, $NO_2$, $SO_3H$, $NH_2$, carboxy, carbo-$C_1$-$C_4$alkoxy, $C_1$-$C_4$alkoxy and $C_1$-$C_4$alkyl, or represents —CO-arylene;

n represents 0; 1; 2 or 3;

n' represents 0; 1 or 2; and each M independently of one another represents hydrogen; an alkali metal ion or an ammonium ion.

The substituents in the naphthyl groups, in the event they are not attached in a fixed position to an individual carbon atom, can be attached in either ring of the naphthyl radical. This is expressed by the horizontal line going through both rings in, for example, in structural formula Xa, Xb and Xc.

For example $C_1$-$C_4$alkylene is methylene, ethylene, propylene or butylene.

Arylene in the context of the description of the instant invention means phenylene or naphthylene, preferably phenylene.

According to a preferred embodiment, the groups D, independently of one another, represent the substituents of a mono-azo dye of the partial formulae XIa, XIb, XIc or XId:

(XIa)

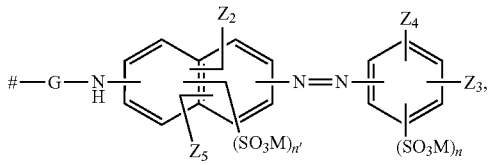

Wherein # marks the point of attachment of the bridging group L;

$Z_2$ represents $C_1$-$C_2$-alkyl, $C_1$-$C_2$-alkyl which is substituted by at least one substituent selected from the group consisting of hydroxy, cyano, $SO_3H$, $NH_2$, carboxy, carbo-$C_1$-$C_2$alkoxy, $C_1$-$C_2$alkoxy, phenyl, naphthyl and pyridyl, $C_1$-$C_2$alkoxy, $C_1$-$C_2$alkoxy which is substituted by at least one substituent selected from the group consisting of hydroxy, cyano, $SO_3H$, $NH_2$, carboxy, carbo-$C_1$-$C_2$alkoxy, $C_1$-$C_2$alkyl, phenyl, naphthyl and pyridyl, or represents OH;

$Z_3$ represents hydrogen, $C_1$-$C_2$-alkyl, $C_1$-$C_2$-alkyl which is substituted by at least one substituent selected from the group consisting of hydroxy, cyano, $SO_3H$, $NH_2$, carboxy, carbo-$C_1$-$C_2$alkoxy, $C_1$-$C_2$alkoxy, phenyl, naphthyl and pyridyl, $C_1$-$C_2$alkoxy, $C_1$-$C_2$alkoxy which is substituted by at least one substituent selected from the group consisting of hydroxy, cyano, $SO_3H$, $NH_2$, carboxy, carbo-$C_1$-$C_2$alkoxy, $C_1$-$C_2$alkyl, phenyl, naphthyl and pyridyl, OH, $NO_2$, $NH_2$, $NHC_1$-$C_2$alkyl, wherein the alkyl group may be substituted by at least one substituent selected from the group consisting of OH, $NH_2$, $C_1$-$C_2$alkyl, CN and COOH, or represents $NHCOC_1$-$C_2$alkyl or $NHCOOC_1$-$C_2$alkyl;

$Z_4$ represents hydrogen, $C_1$-$C_2$-alkyl, $C_1$-$C_2$-alkyl which is substituted by at least one substituent selected from the group consisting of hydroxy, cyano, $SO_3H$, $NH_2$, carboxy, carbo-$C_1$-$C_2$alkoxy, $C_1$-$C_2$alkoxy, phenyl, naphthyl and pyridyl, $C_1$-$C_2$alkoxy, $C_1$-$C_2$alkoxy which is substituted by at least one substituent selected from the group consisting of hydroxy, cyano, $SO_3H$, $NH_2$, carboxy, carbo-$C_1$-$C_4$alkoxy, $C_1$-$C_4$alkyl, phenyl, naphthyl and pyridyl, OH, $NO_2$, $NH_2$, $NHC_1$-$C_2$alkyl, wherein the alkyl group may be substituted by at least one substituent selected from the group consisting of OH, $NH_2$, $C_1$-$C_2$alkyl, CN and COOH, or represents $NHCOC_1$-$C_2$alkyl or $NHCOOC_1$-$C_2$alkyl;

$Z_5$ represents hydrogen, $C_1$-$C_2$-alkyl, $C_1$-$C_2$-alkyl which is substituted by at least one substituent selected from the group consisting of hydroxy, cyano, $SO_3H$, $NH_2$, carboxy, carbo-$C_1$-$C_2$alkoxy, $C_1$-$C_2$alkoxy, phenyl, naphthyl and pyridyl;

G represents the direct bond, $COOC_1$-$C_2$alkylene, arylene, arylene which is substituted by at least one substituent selected from the group consisting of hydroxy, cyano, $NO_2$, $SO_3H$, $NH_2$, carboxy, carbo-$C_1$-$C_2$alkoxy, $C_1$-$C_2$alkoxy and $C_1$-$C_2$alkyl, $C_1$-$C_2$alkylene or $C_1$-$C_2$-alkylene which is substituted by at least one substituent selected from the group consisting of hydroxy, cyano, $NO_2$, $SO_3H$, $NH_2$, carboxy, carbo-$C_1$-$C_2$alkoxy, $C_1$-$C_2$alkoxy and $C_1$-$C_2$alkyl;

n represents 0, 1, 2 or 3;

n' represents 0, 1 or 2; and each M independently of one another represents hydrogen, $Na^+$ or $K^+$;

(XIb)

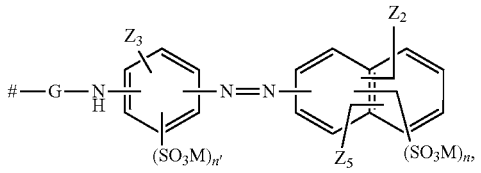

Wherein # marks the point of attachment of the bridging group L;

$Z_2$ represents $C_1$-$C_2$-alkyl, $C_1$-$C_2$-alkyl which is substituted by at least one substituent selected from the group consisting of hydroxy, cyano, $SO_3H$, $NH_2$, carboxy, carbo-$C_1$-$C_2$alkoxy, $C_1$-$C_2$alkoxy, phenyl, naphthyl and pyridyl, $C_1$-$C_2$alkoxy, $C_1$-$C_2$alkoxy which is substituted by at least one substituent selected from the group consisting of hydroxy, cyano, $SO_3H$, $NH_2$, carboxy, carbo-$C_1$-$C_2$alkoxy, $C_1$-$C_2$alkyl, phenyl, naphthyl and pyridyl or represents OH;

$Z_3$ is hydrogen, $C_1$-$C_2$-alkyl, $C_1$-$C_2$-alkyl which is substituted by at least one substituent selected from the group consisting of hydroxy, cyano, $SO_3H$, $NH_2$, carboxy, carbo-$C_1$-$C_2$alkoxy, $C_1$-$C_2$alkoxy, phenyl, naphthyl and pyridyl, $C_1$-$C_2$alkoxy, $C_1$-$C_2$alkoxy which is substituted by at least one substituent selected from the group consisting of hydroxy, cyano, $SO_3H$, $NH_2$, carboxy, carbo-$C_1$-$C_2$alkoxy, $C_1$-$C_2$alkyl, phenyl, naphthyl and pyridyl, OH, $NO_2$, $NH_2$, $NHC_1$-$C_2$alkyl, wherein the alkyl group may be substituted by at least one substituent selected from the group consisting of OH, $NH_2$, $C_1$-$C_2$alkyl, CN or COOH or represents $NHCOC_1$-$C_2$alkyl or $NHCOOC_1$-$C_2$alkyl;

$Z_5$ represents hydrogen, $C_1$-$C_2$-alkyl or $C_1$-$C_2$-alkyl which is substituted by at least one substituent selected from the group consisting of hydroxy, cyano, $SO_3H$, $NH_2$, carboxy, carbo-$C_1$-$C_2$alkoxy, $C_1$-$C_2$alkoxy, phenyl, naphthyl and pyridyl;

G represents the direct bond, $COOC_1$-$C_2$alkylene, arylene, arylene which is substituted by at least one substituent selected from the group consisting of hydroxy, cyano, $NO_2$, $SO_3H$, $NH_2$, carboxy, carbo-$C_1$-$C_2$alkoxy, $C_1$-$C_2$alkoxy and $C_1$-$C_2$alkyl, $C_1$-$C_2$alkylene or $C_1$-$C_2$-alkylene which is substituted by at least one substituent selected from the group consisting of hydroxy, cyano, $NO_2$, $SO_3H$, $NH_2$, carboxy, carbo-$C_1$-$C_2$alkoxy, $C_1$-$C_2$alkoxy and $C_1$-$C_2$alkyl;

n represents 0, 1, 2 or 3;

n' is 0, 1 or 2; and each M independently of one another represents hydrogen, $Na^+$ or $1K^+$;

(XIc)

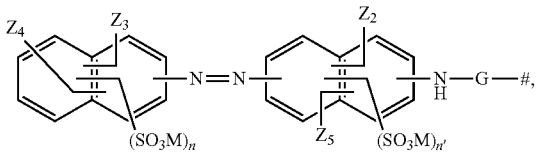

Wherein # marks the point of attachment of the bridging group L;

$Z_2$ represents hydrogen, hydroxy, $C_1$-$C_2$-alkyl, $C_1$-$C_2$-alkyl which is substituted by at least one substituent selected from the group consisting of hydroxy, cyano, $SO_3H$, $NH_2$, carboxy, carbo-$C_1$-$C_2$alkoxy, $C_1$-$C_2$alkoxy, phenyl, naphthyl and pyridyl, $C_1$-$C_2$alkoxy or $C_1$-$C_2$alkoxy which is substituted by at least one substituent selected from the group consisting of hydroxy, cyano, $SO_3H$, $NH_2$, carboxy, carbo-$C_1$-$C_4$alkoxy, $C_1$-$C_4$alkyl, phenyl, naphthyl and pyridyl, or represents $NO_2$;

$Z_3$ represents hydrogen, $C_1$-$C_2$-alkyl, $C_1$-$C_2$-alkyl which is substituted by at least one substituent selected from the group consisting of hydroxy, cyano, $SO_3H$, $NH_2$, carboxy, carbo-$C_1$-$C_2$alkoxy, $C_1$-$C_2$alkoxy, phenyl, naphthyl and pyridyl, $C_1$-$C_2$alkoxy, $C_1$-$C_2$alkoxy which is substituted by at least one substituent selected from the group consisting of hydroxy, cyano, $SO_3H$, $NH_2$, carboxy, carbo-$C_1$-$C_2$alkoxy, $C_1$-$C_2$alkyl, phenyl, naphthyl and pyridyl, OH, $NO_2$, $NH_2$, $NHC_1$-$C_2$alkyl, wherein the alkyl group may be substituted by at least one substituent selected from the group consisting of OH, $NH_2$, $C_1$-$C_2$alkyl, CN and COOH, or represents $NHCOC_1$-$C_2$alkyl or $NHCOOC_1$-$C_2$alkyl;

$Z_4$ represents hydrogen, $C_1$-$C_2$-alkyl, $C_1$-$C_2$-alkyl which is substituted by at least one substituent selected from the group consisting of hydroxy, cyano, $SO_3H$, $NH_2$, carboxy, carbo-$C_1$-$C_2$alkoxy, $C_1$-$C_2$alkoxy, phenyl, naphthyl and pyridyl, $C_1$-$C_2$alkoxy or $C_1$-$C_2$alkoxy which is substituted by at least one substituent selected from the group consisting of hydroxy, cyano, $SO_3H$, $NH_2$, carboxy, carbo-$C_1$-$C_4$alkoxy, $C_1$-$C_4$alkyl, phenyl, naphthyl and pyridyl, OH, $NO_2$, $NH_2$, $NHC_1$-$C_2$alkyl, wherein the alkyl group may be substituted by at least one substituent selected from the group consisting of OH, $NH_2$, $C_1$-$C_2$alkyl, CN and COOH, or represents $NHCOC_1$-$C_2$alkyl or $NHCOOC_1$-$C_2$alkyl;

$Z_5$ represents hydrogen, $C_1$-$C_2$-alkyl, $C_1$-$C_2$-alkyl which is substituted by at least one substituent selected from the group consisting of hydroxy, cyano, $SO_3H$, $NH_2$, carboxy, carbo-$C_1$-$C_2$alkoxy, $C_1$-$C_2$alkoxy, phenyl, naphthyl and pyridyl, $C_1$-$C_2$alkoxy, $C_1$-$C_2$alkoxy, which is substituted by at least one substituent selected from the group consisting of hydroxy, cyano, $SO_3H$, $NH_2$, carboxy, carbo-$C_1$-$C_4$alkoxy, $C_1$-$C_4$alkyl, phenyl, naphthyl and pyridyl, or represents $NO_2$;

G represents the direct bond, $COOC_1$-$C_2$alkylene, arylene, arylene which is substituted by at least one substituent selected from the group consisting of hydroxy, cyano, $NO_2$, $SO_3H$, $NH_2$, carboxy, carbo-$C_1$-$C_2$alkoxy, $C_1$-$C_2$alkoxy and $C_1$-$C_2$alkyl, $C_1$-$C_2$alkylene or $C_1$-$C_2$-alkylene which is substituted by at least one substituent selected from the group consisting of hydroxy, cyano, $NO_2$, $SO_3H$, $NH_2$, carboxy, carbo-$C_1$-$C_2$alkoxy, $C_1$-$C_2$alkoxy and $C_1$-$C_2$alkyl;

n represents 0, 1, 2 or 3;

n' represents 0, 1 or 2; and each M independently of one another represents $Na^+$ or $K^+$;

(XId)

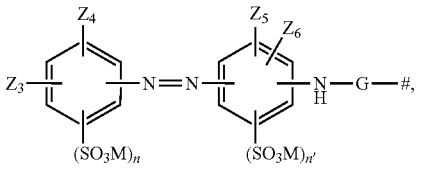

wherein # marks the point of attachment of the bridging group L;

$Z_3$ represents hydrogen, $C_1$-$C_2$-alkyl, $C_1$-$C_2$-alkyl which is substituted by at least one substituent selected from the group consisting of hydroxy, cyano, $SO_3H$, $NH_2$, carboxy, carbo-$C_1$-$C_2$alkoxy, $C_1$-$C_2$alkoxy, phenyl, naphthyl and pyridyl, $C_1$-$C_2$alkoxy, $C_1$-$C_2$alkoxy which is substituted by at least one substituent selected from the group consisting of hydroxy, cyano, $SO_3H$, $NH_2$, carboxy, carbo-$C_1$-$C_4$alkoxy, $C_1$-$C_4$alkyl, phenyl, naphthyl and pyridyl, or represents $SO_2CH_2CH_2SO_3H$ or $NO_2$;

$Z_4$ represents $C_1$-$C_2$-alkyl, $C_1$-$C_2$-alkyl which is substituted by at least one substituent selected from the group consisting of hydroxy, cyano, $SO_3H$, $NH_2$, carboxy, carbo-$C_1$-$C_2$alkoxy, $C_1$-$C_2$alkoxy, phenyl, naphthyl and pyridyl, $C_1$-$C_2$alkoxy, $C_1$-$C_2$alkoxy which is substituted by at least one substituent selected from the group consisting of hydroxy, cyano, $SO_3H$, $NH_2$, carboxy, carbo-$C_1$-$C_4$alkoxy, $C_1$-$C_4$alkyl, phenyl, naphthyl and pyridyl, OH, or represents $SO_2CH_2CH_2SO_3H$, or $NO_2$;

$Z_5$ represents hydrogen, $C_1$-$C_2$-alkyl, $C_1$-$C_2$-alkyl which is substituted by at least one substituent selected from the group consisting of hydroxy, cyano, $SO_3H$, $NH_2$, carboxy, carbo-$C_1$-$C_2$alkoxy, $C_1$-$C_2$alkoxy, phenyl, naphthyl and pyridyl, $C_1$-$C_2$alkoxy, $C_1$-$C_2$alkoxy which is substituted by at least one substituent selected from the group consisting of hydroxy, cyano, $SO_3H$, $NH_2$, carboxy, carbo-$C_1$-$C_4$alkoxy, $C_1$-$C_4$alkyl, phenyl, naphthyl and pyridyl, OH, $NO_2$, $NH_2$, $NHC_1$-$C_2$alkyl, wherein the alkyl group may be substituted by at least one substituent selected from the group consisting of OH, $NH_2$, $C_1$-$C_2$alkyl, CN and COOH, or represents $NHCOC_1$-$C_2$alkyl or $NHCOOC_1$-$C_2$alkyl;

$Z_6$ represents $C_1$-$C_2$-alkyl, $C_1$-$C_2$-alkyl which is substituted by at least one substituent selected from the group consisting of hydroxy, cyano, $SO_3H$, $NH_2$, carboxy, carbo-$C_1$-$C_2$alkoxy, $C_1$-$C_2$alkoxy, phenyl, naphthyl and pyridyl, $C_1$-$C_2$alkoxy, $C_1$-$C_2$alkoxy which is substituted by at least one substituent selected from the group consisting of hydroxy, cyano, $SO_3H$, $NH_2$, carboxy, carbo-$C_1$-$C_4$alkoxy, $C_1$-$C_4$alkyl, phenyl, naphthyl and pyridyl, or represents $NO_2$;

G represents the direct bond, $COOC_1$-$C_2$alkylene, arylene, arylene which is substituted by at least one substituent selected from the group consisting of hydroxy, cyano, $NO_2$, $SO_3H$, $NH_2$, carboxy, carbo-$C_1$-$C_2$alkoxy, $C_1$-$C_2$alkoxy and $C_1$-$C_2$alkyl, $C_1$-$C_2$alkylene or $C_1$-$C_2$-alkylene which is substituted by at least one substituent selected from the group consisting of hydroxy, cyano, $NO_2$, $SO_3H$, $NH_2$, carboxy, carbo-$C_1$-$C_2$alkoxy, $C_1$-$C_2$alkoxy and $C_1$-$C_2$alkyl;

n represents 0, 1, 2 or 3;

n' represents 0, 1 or 2; and each M independently of one another represents hydrogen, $Na^+$ or $K^+$.

According to a particularly preferred embodiment, D is selected from the group consisting of compounds, wherein the partial formulae 10, 11, 12, 13 and 14:

(10)

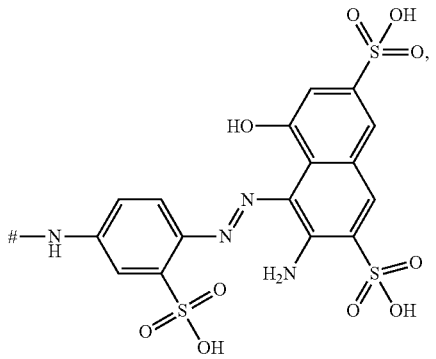

(11)

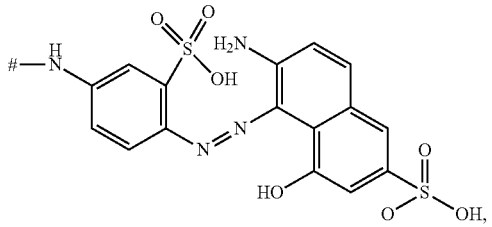

(12)

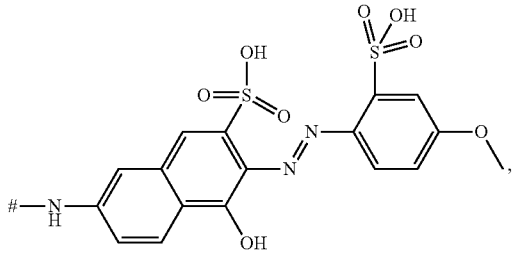

(13)

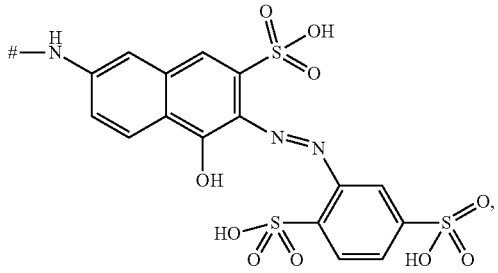

-continued (14)

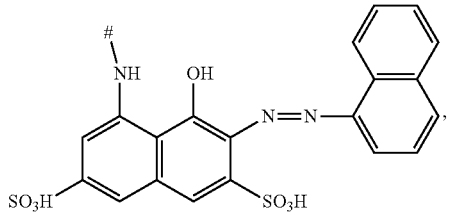

are present and wherein # marks the point of attachment of the bridging group L.

The sulphonic acid groups of the dyes represented by —$SO_3H$ may also be in the form of their salts, in particular of alkali metal salts, such as Na, K or Li salts or as ammonium salts. Also mixtures of the free acid and the corresponding salts are embraced.

A particularly suitable individual phthalocyanine is represented by the following formula wherein the degree of sulphonation is between 1 and 3 in the phthalocyanine ring:

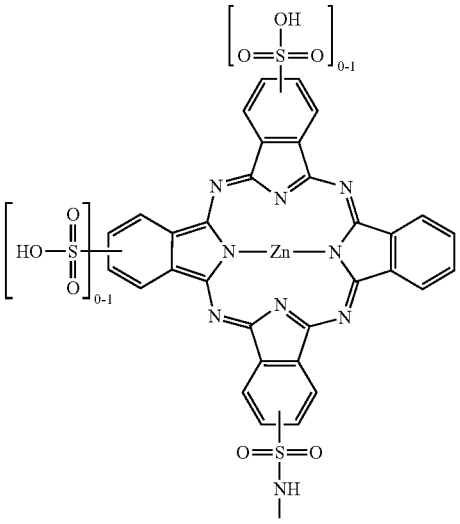

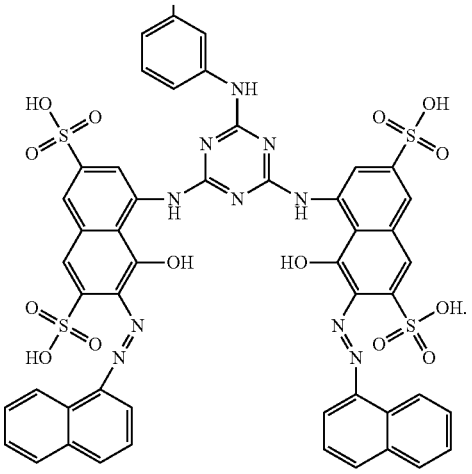

According to another preferred embodiment, the water-soluble phthalocyanine complex compound (1) corresponds to the formula

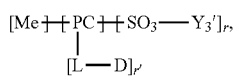

(3a)

wherein

PC, L and D are as defined above (including the preferences);

Me is Zn or Al—$Z_1$, $Z_1$ is chlorine, fluorine, bromine or hydroxy;

$Y_3$' is hydrogen; an alkali metal ion or ammonium ion;

r is zero or a numeral from 1-3; and r' is a numeral from 1 to 4.

The amount of water-soluble phthalocyanine complex compounds (1) present in the particles may vary within wide limits A preferred range is 0.01-20.0 wt.-%, particularly 0.1-20 wt.-%, especially 1-15.0 wt.-%, based on the total weight of the particles. Highly preferred is a range of 2-15.0 wt.-%, especially 2-10 wt.-%.

For the synthesis of the water-soluble phthalocyanine complex compounds (1), two different reaction sequences are available: either by initial synthesis of a metal-free phthalocyanine derivative and subsequent complexation with a metal salt or by synthesis of a phthalocyanine ring system from a simple benzenoid precursor by concomitant incorporation of the metal ion.

Substituents can be introduced before or after the formation of the phthalocyanine ring structure.

A suitable method to obtain water-soluble phthalocyanine complex compounds (1) is the introduction of sulphonate groups, for example by sulphonation of the unsubstituted metal phthalocyanine with 1-4 sulpho groups:

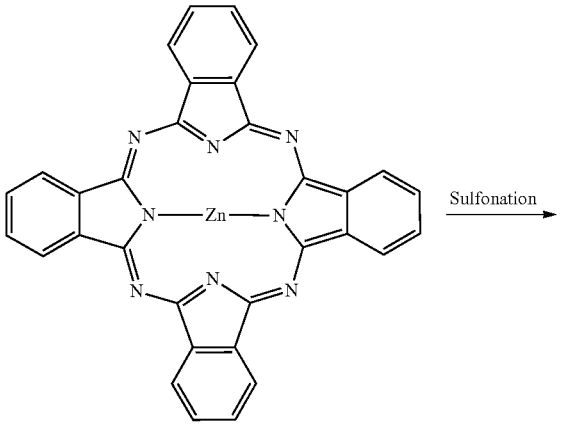

-continued

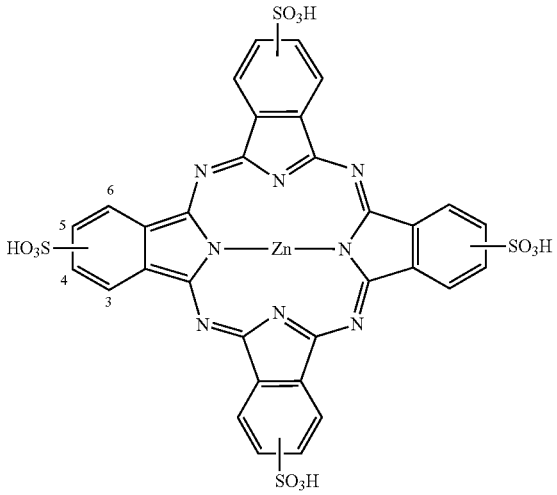

The sulphonated phthalocyanine complex compounds are mixtures of different structure and different positional isomers. The —$SO_3H$-group can be located at positions 3, 4, 5 or 6. Also the degree of sulphonation is varying. For example, a tetra sodium salt of the zinc phthalocyanine can be prepared according to known procedure: J. Griffiths et al., *Dyes and Pigments, Vol.* 33, 65-78 (1997) and the literature cited therein.

Another method to obtain a sulphonated metal phthalocyanine is reacting a sulpho phthalic acid with a metal salt, urea and a molybdate catalyst in a melt condensation. The position of the sulphonation is determined by the corresponding phthalic acid reactant. If 4-sulphophthalic acid is used, a tetrasulphonated metal phthalocyanine with sulphonic acid groups exclusively in position 4 or 5 is obtained.

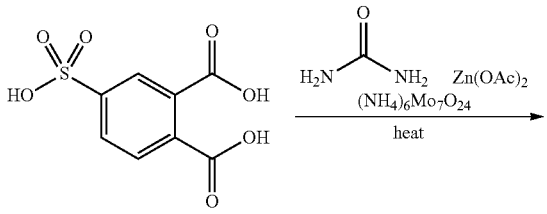

-continued

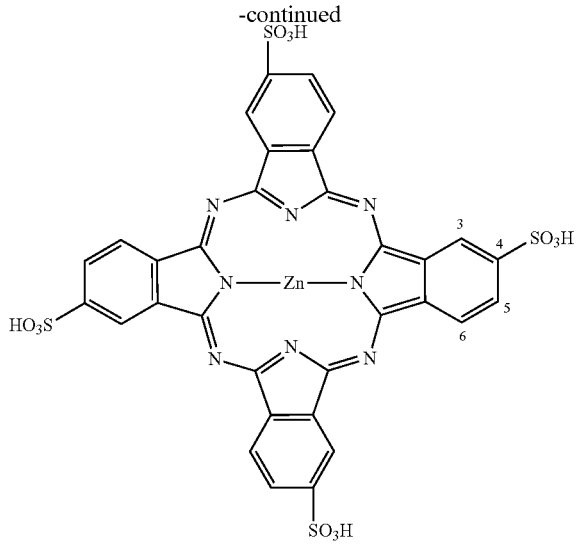

The content of sulphonic acid groups can be adjusted by addition of phthalic acid. With this melt process sulphonated zinc phthalocyanine derivatives having a degree of sulphonation between DS=1-4 can be prepared.

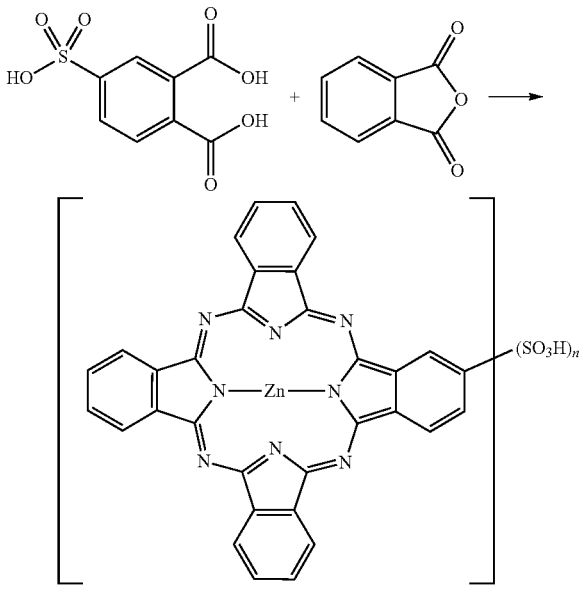

n = 1, 2, 3, 4

In the particles according to the present application, the phthalocyanine complex is being linked with a mono-azo dye molecule corresponding to D via specific linking groups L. A convenient way to realize this linkage is the synthesis of a metal phthalocyanine sulphonyl chloride by a sulphochlorination reaction after known procedures (DE 2812261, DE 0153278). By varying the amount of the sulphochlorination agent, the desired degree of sulpho chloride content can be adjusted. The sulphochlorination reaction of phthalocyanines generally leads to a main product, but as by-products small amounts of lower or higher degree of sulphonyl chloride groups are detected.

The resulting reactive phthalocyanine-sulphonyl chloride can then be reacted further with a suitable dye having an amino group. To illustrate the synthesis, the following synthetic examples leading to zinc and aluminium phthalocyanines linked with amino functionalized azo dyes are given. The syntheses are performed as shown in the following scheme. From the possible positional isomers, only one is shown. The formation of the side products (degree of —$SO_3R$ and $SO_2Cl$) is not shown.

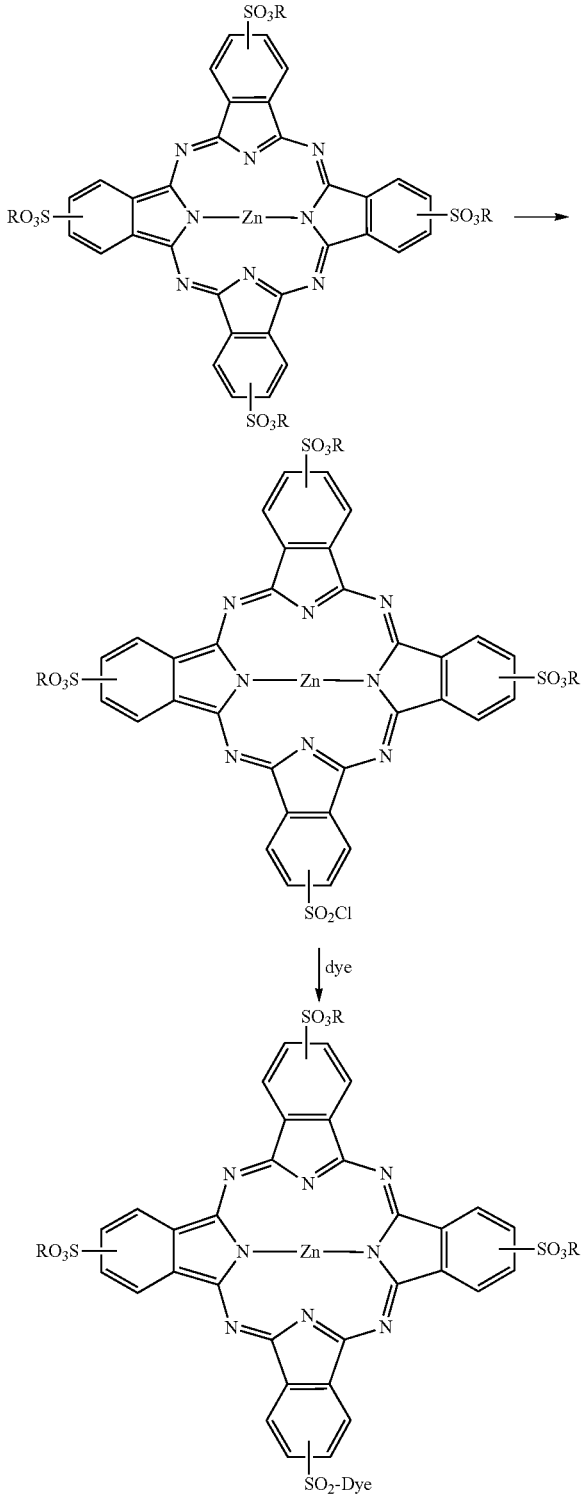

R = H or Na
DS 3-4

The synthesis of zinc phthalocyanine complex compounds with a lower degree of sulphonation and analogous activation and coupling to the corresponding zinc phthalocyanine azo dyes is also possible.

The synthesis of exactly tris-sulphonated zinc phthalocyanine derivatives is known from literature [J. E. van Lier, *Journ. Med. Chem*. (1997), 40 (24) 3897] as a product from ring expansion reaction of boron tri(4-sulpho)sub-phthalocyanine.

The synthesis of metal phthalocyanines with lower degree of sulphonation can also be performed by a modified sulphonation reaction, for example by shortening of reaction time and/or reduction of reaction temperature (WO 2009068513 and WO 2009069077).

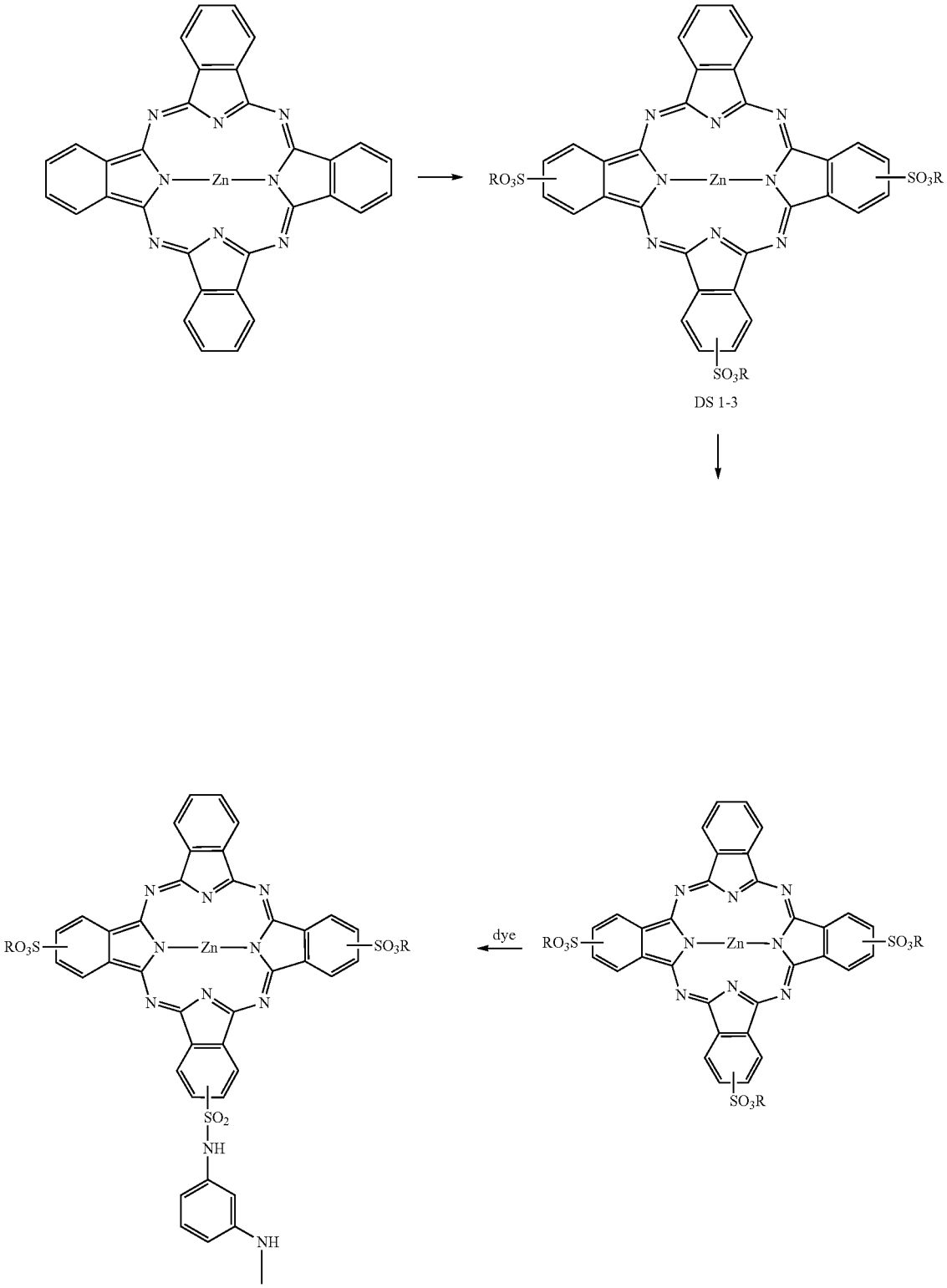

-continued

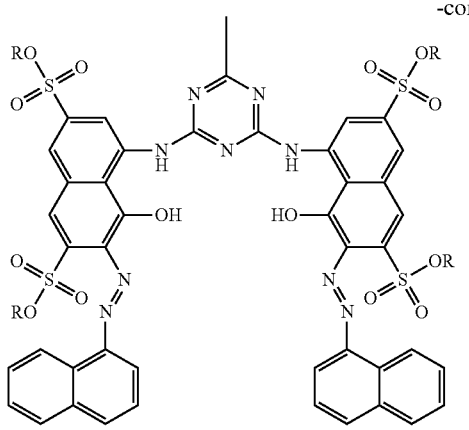

R = H or Na

As component b) all kinds of gelatine may be used. Examples are gelatines of the gelling type and gelatine hydrolysates. Gelatines of the gelling type show, when immersed in water, hydration, whereas for Gelatine hydrolysates no gelation is observed (see Ullmann's Encyclopedia of Industrial Chemistry, 2012, Vol. 16, pages 579-593). In order to obtain a desired bloom strength, gelatines of different bloom values may be used. Variation of the weight ratio results in the desired bloom value. For example, gelatine of bloom strength 0 and gelatine of bloom strength 100 can be used in different weight ratios to adjust the bloom strength; the resulting bloom strength is in general proportional to the amount of gelatine having a bloom strength of 100.

Bloom strength, also referred to as gel strength, is determined with a Bloom gelometer (S. Williams (ed.): Official Methods of Analysis of the Association of Official Analytical Chemists, 14th ed., 23, AOAC, Inc., Arlington, Va. 1984, p. 429; or U.S. Pat. No. 1,540,979). The Bloom strength is determined as follows: 6.67% solution of the gelatine sample is prepared in a special wide-mouthed test bottle, which is then cooled to 10.0±0.1° C. and kept for 17±1 h for maturation at this temperature. The firmness of the resulting gel is then measured with a gelometer. This instrument impresses a standard plunger (12.7 mm diameter, plane surface, sharp edges) into the surface of the gel. The force required to depress the plunger 4 mm into the gel is the gel strength or Bloom value of the gelatin.

Preferred as gelatine component b) are those having a Bloom strength of 2 to 50, especially 3 to 50 and more preferably 4 to 50. Highly preferred are those having a bloom strength of 6 to 50, especially 8 to 50. As upper limit a value of 40, especially 30, is preferred.

The amount of the gelatine component b) is preferably 3-60% by weight, more preferably 5-50% by weight and especially preferably 10-40% by weight, based on the total weight of the particles. Highly preferred is an amount of 15-35% by weight.

In a preferred embodiment of the present invention the particles may comprise in addition sugar, like saccharose or glucose, for example as glucose syrup. The amount of the optional sugar component, if present, is preferably 0.01-60% by weight, more preferably 1-50% by weight and especially preferably 1-40% by weight, based on the total weight of the particles. Highly preferred is an amount of 5-40% by weight.

The optional oil component c) is preferably a triglyceride oil, or a modified triglyceride oil. These include vegetable oils such as jojoba, soybean, canola, sunflower, safflower, rice bran, avocado, almond, olive, sesame, persic, castor, coconut, and mink oils, as well as raffinates thereof. Synthetic triglycerides may also be employed. Modified triglycerides include materials such as ethoxylated and maleated triglyceride derivatives. Preferred are vegetable oils, especially coconut oil. Further preference is given to medium chain triglycerides.

The amount of the oil component c), if present, is preferably 0.01-10% by weight, more preferably 0.1-10% by weight and especially preferably 0.1-5% by weight, based on the total weight of the particles. Highly preferred is an amount of 0.1-2.5% by weight.

As optional powdering agent component d) any conventional powdering agent may be used, such as a starch, e.g. corn starch, a modified starch, tri-calcium phosphate, lactose, mannitol, ethylcellulose, coagulated albumin, hardened gelatine, casein, stearate-Ca, stearate-Na, a metal soap, hydrogenated *ricinus* oil, polyoxide, talcum, a wax, silica or a silicate. Preference is given to starch and modified starch. The powdering agent can be used in order to separate the particles during drying, to prevent agglomeration of the particles. The use of a powdering agent is preferred.

The amount of the optional powdering agent component d), if present, is preferably 1-90% by weight, more preferably 5-90% by weight and especially preferably 10-90% by weight, based on the total weight of the particles. Highly preferred is an amount of 10-50% by weight.

The optional additives components e) may be anionic dispersing agents; inorganic salts, aluminium silicates such as zeolites, and also compounds such as talc, kaolin; disintegrants such as, for example, powdered or fibrous cellulose, microcrystalline cellulose; fillers such as, for example, dextrin, starch as for example corn starch or potato starch; water-insoluble or water-soluble dyes or pigments; and also optical brighteners. $TiO_2$, $SiO_2$ or magnesium trisilicate may also be used in small amounts, for example 0.0 to 10.0% by weight, based on the weight of the particles.

The anionic dispersing agents used are, for example, the commercially available water-soluble anionic dispersing agents for dyes, pigments etc.

The following products are listed as examples: condensation products of aromatic sulphonic acids and formaldehyde, condensation products of aromatic sulphonic acids with unsubstituted or chlorinated biphenyls or biphenyl oxides and optionally formaldehyde, (mono-/di-)alkylnaphthalene-sulphonates, sodium salts of polymerized organic sulphonic acids, sodium salts of polymerized alkylnaphthalenesulphonic acids, sodium salts of polymerized alkylbenzenesulphonic acids, alkylarylsulphonates, sodium salts of alkyl polyglycol ether sulphates, polyalkylated polynuclear arylsulphonates, methylene-linked condensation products of arylsulphonic acids and hydroxyarylsulphonic acids, sodium salts of dialkylsulphosuccinic acids, sodium salts of alkyl diglycol ether sulphates, sodium salts of polynaphthalene-methanesulphonates, ligno- or oxyligno-sulphonates or heterocyclic polysulphonic acids.

Especially suitable anionic dispersing agents are condensation products of naphthalene sulphonic acids with formaldehyde, sodium salts of polymerized organic sulphonic acids, (mono-/di-)alkylnaphthalenesulphonates, polyalkylated polynuclear arylsulphonates, sodium salts of polymerized alkylbenzenesulphonic acid, lignosulphonates, oxylignosulphonates and condensation products of naphthalenesulphonic acid with a polychloromethylbiphenyl.

The amount of the optional additives component e), if present, is preferably 0.01-90% by weight, more preferably 1-90% by weight and especially preferably 1-60% by weight, based on the total weight of the particles. Highly preferred is an amount of 1-50% by weight.

The particles according to the present invention may contain residual moisture as component f). This water level may range from 0.1-15% by weight, more preferably 1-10% by weight, based on the total weight of the particles.

According to a preferred embodiment, the particles have an average particle size of <1000 μm, especially <500 μm.

According to a particularly preferred embodiment, the particles have an average particle size of 50 to 400 μm.

A preferred embodiment of the present invention relates to particles comprising a) 0.1-20 wt.-% of at least one water-soluble phthalocyanine compound;

b) 5-60 wt.-% of gelatine having a bloom strength of 2 to 80;

c) 0-10 wt.-% of an oil, d) 0-90 wt.-% of a powdering agent, e) 0-90 wt.-% of further additives suitable for the preparation of solid agglomerates, and f) 0-15 wt.-% of water, provided that the sum of components a), b), c), d), e) and f) amounts up to 100 wt.-%.

A particularly preferred embodiment of the present invention relates to particles comprising a) 1-15 wt.-% of at least one water-soluble phthalocyanine compound;

b) 5-50 wt.-% of gelatine having a bloom strength of 2 to 80;

c) 0.1-5 wt.-% of an oil, d) 1-90 wt.-% of a powdering agent, e) 0-90 wt.-% of further additives suitable for the preparation of solid agglomerates, and f) 0.1-15 wt.-% of water, provided that the sum of components a), b), c), d), e) and f) amounts up to 100 wt.-%.

As to each of the components a), b), c), d), e) and f) of the above particles the preferences given before apply.

The present invention also relates to a process for the preparation of the particles described above, which comprises i) dissolving at least one water-soluble phthalocyanine compound in an aqueous medium, ii) dissolving gelatine having a bloom strength of 2 to 80 in the resulting solution, or adding an aqueous solution of said gelatine, iii) converting the mixture thus obtained into droplets, and iv) reducing the moisture content of the resulting particles.

The particles according to the present invention are prepared according to known methods.

In general, a mixture comprising all required components for the preparation of the particles (except for powdering agent component d)), is subjected to spray-drying. Spray-drying may be carried out at a temperature of 40 to 140° C. According to one embodiment spray-drying is carried out at temperatures of 40 to 100° C., especially 60 to 100° C. According to a further embodiment of the present invention spray-drying is carried out at temperatures of 100 to 140° C., especially 100 to 130° C. During spray-drying, the particles may be covered by powdering agents according to know methods. Usually, after spray-drying, the particles are dried at temperatures ranging from 20-60° C., especially at 40° C. The resulting powder may then be sieved to get the desired particle size. In a preferred method spray-drying is performed while introducing the powdering agent component d) into the spray-drying zone.

The present invention also relates to compositions comprising the particles referred to above.

Such compositions may be liquid, solid, paste-like or gel-like. The compositions, especially washing agent compositions but also washing agent additives or additive concentrates, for example pre- and/or after-treatment agents, stain-removing salt, washing-power enhancers, fabric conditioners, bleaching agents, UV-protection enhancers etc., may be in any known and customary form, especially in the form of powders, (super) compact powders, in the form of single- or multi-layer tablets (tabs), bars, blocks, sheets or pastes, or in the form of pastes, gels or liquids used in capsules or in pouches (sachets). Powders may also be used in suitable sachets or pouches.

Laundry Detergent Composition:

The laundry detergent composition may be in liquid, solid or unit dose form such as a tablet or a pouch, preferably a water-soluble pouch. When in unit dose form, the composition may be at least partially, preferably completed enclosed by a water-soluble film such as polyvinyl alcohol. Preferably, the composition is in solid form.

Solid Laundry Detergent Composition:

Typically, the composition is a fully formulated laundry detergent composition, not a portion thereof such as a spray-dried or agglomerated particle that only forms part of the laundry detergent composition. However, it is within the scope of the present invention for an additional rinse additive composition (e.g. fabric conditioner or enhancer), or a main wash additive composition (e.g. bleach additive) to also be used in combination with the laundry detergent composition during the method of the present invention. Although it may be preferred for no bleach additive composition to be used in combination with the laundry detergent composition during the method of the present invention.

Typically, the composition comprises a plurality of chemically different particles, such as spray-dried base detergent particles and/or agglomerated base detergent particles and/or extruded base detergent particles, in combination with one or more, typically two or more, or three or more, or four or more, or five or more, or six or more, or even ten or more particles selected from: surfactant particles, including surfactant agglomerates, surfactant extrudates, surfactant needles, surfactant noodles, surfactant flakes; polymer particles such as cellulosic polymer particles, polyester particles, polyamine particles, terephthalate polymer particles, polyethylene glycol polymer particles; builder particles, such as sodium carbonate and sodium silicate co-builder particles, phosphate particles, zeolite particles, silicate salt particles, carbonate salt particles; filler particles such as sulphate salt particles;

dye transfer inhibitor particles; dye fixative particles; bleach particles, such as percarbonate particles, especially coated percarbonate particles, such as percarbonate coated with carbonate salt, sulphate salt, silicate salt, borosilicate salt, or any combination thereof, perborate particles, bleach catalyst particles such as transition metal bleach catalyst particles, or oxaziridinium based bleach catalyst particles, pre-formed peracid particles, especially coated preformed peracid particles, and co-bleach particles of bleach activator, source of hydrogen peroxide and optionally bleach catalyst; bleach activator particles such as oxybenzene sulphonate bleach activator particles and tetra acetyl ethylene diamine bleach activator particles; chelant particles such as chelant agglomerates; hueing dye particles; brightener particles; enzyme particles such as protease prills, lipase prills, cellulase prills, amylase prills, mannanase prills, pectate lyase prills, xyloglucanase prills, bleaching enzyme prills, cutinase prills and co-prills of any of these enzymes; clay particles such as montmorillonite particles or particles of clay and silicone; flocculant particles such as polyethylene oxide particles; wax particles such as wax agglomerates; perfume particles such as perfume microcapsules, especially melamine formaldehyde-based perfume microcapsules, starch encapsulated perfume accord particles, and pro-perfume particles such as Schiff base reaction product particles; aesthetic particles such as coloured noodles or needles or lamellae particles, and soap rings including coloured soap rings; and any combination thereof.

Detergent Ingredients:

The composition typically comprises detergent ingredients. Suitable detergent ingredients include; detersive surfactants including anionic detersive surfactants, non-ionic detersive surfactants, cationic detersive surfactants, zwitterionic detersive surfactants, amphoteric detersive surfactants, and any combination thereof; polymers including carboxylate polymers, polyethylene glycol polymers, polyester soil release polymers such as terephthalate polymers, amine polymers, cellulosic polymers, dye transfer inhibition polymers, dye lock polymers such as a condensation oligomer produced by condensation of imidazole and epichlorhydrin, optionally in ratio of 1:4:1, hexamethylenediamine derivative polymers, and any combination thereof; builders including zeolites, phosphates, citrate, and any combination thereof; buffers and alkalinity sources including carbonate salts and/or silicate salts; fillers including sulphate salts and bio-filler materials; bleach including bleach activators, sources of available oxygen, pre-formed peracids, bleach catalysts, reducing bleach, and any combination thereof; chelants; photobleach; hueing agents; brighteners; enzymes including proteases, amylases, cellulases, lipases, xylogucanases, pectate lyases, mannanases, bleaching enzymes, cutinases, and any combination thereof; fabric softeners including clay, silicones, quaternary ammonium fabric-softening agents, and any combination thereof; flocculants such as polyethylene oxide; perfume including starch encapsulated perfume accords, perfume microcapsules, perfume loaded zeolites, schif base reaction products of ketone perfume raw materials and polyamines, blooming perfumes, and any combination thereof; aesthetics including soap rings, lamellar aesthetic particles, geltin beads, carbonate and/or sulphate salt speckles, coloured clay, and any combination thereof: and any combination thereof.

Detersive Surfactant:

The composition typically comprises detersive surfactant. Suitable detersive surfactants include anionic detersive surfactants, non-ionic detersive surfactant, cationic detersive surfactants, zwitterionic detersive surfactants, amphoteric detersive surfactants, and any combination thereof.

Anionic Detersive Surfactant:

Suitable anionic detersive surfactants include sulphate and sulphonate detersive surfactants.

Suitable sulphonate detersive surfactants include alkyl benzene sulphonate, such as $C_{10-13}$ alkyl benzene sulphonate. Suitable alkyl benzene sulphonate (LAS) is obtainable, or even obtained, by sulphonating commercially available linear alkyl benzene (LAB); suitable LAB includes low 2-phenyl LAB, such as those supplied by Sasol under the tradename Isochem® or those supplied by Petresa under the tradename Petrelab®, other suitable LAB include high 2-phenyl LAB, such as those supplied by Sasol under the tradename Hyblene®. Another suitable anionic detersive surfactant is alkyl benzene sulphonate that is obtained by DETAL catalyzed process, although other synthesis routes, such as HF, may also be suitable.

Suitable sulphate detersive surfactants include alkyl sulphate, such as $C_{8-18}$ alkyl sulphate, or predominantly $C_{12}$ alkyl sulphate. The alkyl sulphate may be derived from natural sources, such as coco and/or tallow. Alternative, the alkyl sulphate may be derived from synthetic sources such as $C_{12-15}$ alkyl sulphate.

Another suitable sulphate detersive surfactant is alkyl alkoxylated sulphate, such as alkyl ethoxylated sulphate, or a $C_{8-18}$ alkyl alkoxylated sulphate, or a $C_{8-18}$ alkyl ethoxylated sulphate. The alkyl alkoxylated sulphate may have an average degree of alkoxylation of from 0.5 to 20, or from 0.5 to 10. The alkyl alkoxylated sulphate may be a $C_{8-18}$ alkyl ethoxylated sulphate, typically having an average degree of ethoxylation of from 0.5 to 10, or from 0.5 to 7, or from 0.5 to 5 or from 0.5 to 3.

The alkyl sulphate, alkyl alkoxylated sulphate and alkyl benzene sulphonates may be linear or branched, substituted or un-substituted.

The anionic detersive surfactant may be a mid-chain branched anionic detersive surfactant, such as a mid-chain branched alkyl sulphate and/or a mid-chain branched alkyl benzene sulphonate. The mid-chain branches are typically $C_{1-4}$ alkyl groups, such as methyl and/or ethyl groups.

Another suitable anionic detersive surfactant is alkyl ethoxy carboxylate.

The anionic detersive surfactants are typically present in their salt form, typically being complexed with a suitable cation. Suitable counter-ions include $Na^+$ and $K^+$, substituted ammonium such as $C_1$-$C_6$ alkanolammonium such as monoethanolamine (MEA) tri-ethanolamine (TEA), di-ethanolamine (DEA), and any mixture thereof.

Non-Ionic Detersive Surfactant:

Suitable non-ionic detersive surfactants are selected from the group consisting of: $C_8$-$C_{18}$ alkyl ethoxylates, such as, NEODOL® non-ionic surfactants from Shell; $C_6$-$C_{12}$ alkyl phenol alkoxylates wherein optionally the alkoxylate units are ethyleneoxy units, propyleneoxy units or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols; $C_{14}$-$C_{22}$ mid-chain branched alkyl alkoxylates, typically having an average degree of alkoxylation of from 1 to 30; alkylpolysaccharides, such as alkylpolyglycosides; polyhydroxy fatty acid amides; ether capped poly(oxyalkylated) alcohol surfactants; and mixtures thereof.

Suitable non-ionic detersive surfactants are alkyl polyglucoside and/or an alkyl alkoxylated alcohol.

Suitable non-ionic detersive surfactants include alkyl alkoxylated alcohols, such as $C_{8-18}$ alkyl alkoxylated alcohol, or a $C_{8-18}$ alkyl ethoxylated alcohol. The alkyl alkoxylated alcohol may have an average degree of alkoxylation of from 0.5 to 50, or from 1 to 30, or from 1 to 20, or from 1 to 10. The alkyl alkoxylated alcohol may be a $C_{8-18}$ alkyl ethoxylated alcohol, typically having an average degree of ethoxylation of from 1 to 10, or from 1 to 7, or from 1 to 5, or from 3 to 7. The alkyl alkoxylated alcohol can be linear or branched, and substituted or un-substituted.

Suitable nonionic detersive surfactants include secondary alcohol-based detersive surfactants having the formula:

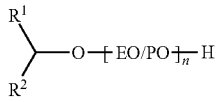

wherein $R^1$=linear or branched, substituted or unsubstituted, saturated or unsaturated $C_{2-8}$ alkyl;

wherein $R^2$=linear or branched, substituted or unsubstituted, saturated or unsaturated $C_{2-8}$ alkyl, wherein the total number of carbon atoms present in $R^1+R^2$ moieties is in the range of from 7 to 13;

wherein EO/PO are alkoxy moieties selected from ethoxy, propoxy, or mixtures thereof, optionally the EO/PO alkoxyl moieties are in random or block configuration;

wherein n is the average degree of alkoxylation and is in the range of from 4 to 10.

Other suitable non-ionic detersive surfactants include EO/PO block co-polymer surfactants, such as the Plurafac® series of surfactants available from BASF, and sugar derived surfactants such as alkyl N-methyl glucose amide.

Cationic Detersive Surfactant:

Suitable cationic detersive surfactants include alkyl pyridinium compounds, alkyl quaternary ammonium compounds, alkyl quaternary phosphonium compounds, alkyl ternary sulphonium compounds, and mixtures thereof.

Suitable cationic detersive surfactants are quaternary ammonium compounds having the general formula:

$$(R)(R_1)(R_2)(R_3)N^+X^-$$

wherein, R is a linear or branched, substituted or unsubstituted $C_{6-18}$ alkyl or alkenyl moiety, $R_1$ and $R_2$ are independently selected from methyl or ethyl moieties, $R_3$ is a hydroxyl, hydroxymethyl or a hydroxyethyl moiety, X is an anion which provides charge neutrality, suitable anions include: halides, such as chloride; sulphate; and sulphonate. Suitable cationic detersive surfactants are mono-$C_{6-18}$ alkyl mono-hydroxyethyl di-methyl quaternary ammonium chlorides. Suitable cationic detersive surfactants are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride.

Zwitterionic and/or Amphoteric Detersive Surfactant:

Suitable zwitterionic and/or amphoteric detersive surfactants include amine oxide such as dodecyldimethylamine N-oxide, alkanolamine sulphobetaines, coco-amidopropyl betaines, $HN^+$—R—$CO_2^-$ based surfactants, wherein R can be any bridging group, such as alkyl, alkoxy, aryl or amino acids.

Polymer:

Suitable polymers include carboxylate polymers, polyethylene glycol polymers, polyester soil release polymers such as terephthalate polymers, amine polymers, cellulosic polymers, dye transfer inhibition polymers, dye lock polymers such as a condensation oligomer produced by condensation of imidazole and epichlorhydrin, optionally in ratio of 1:4:1, hexamethylenediamine derivative polymers, and any combination thereof.

Carboxylate Polymer:

Suitable carboxylate polymers include maleate/acrylate random copolymer or polyacrylate homopolymer. The carboxylate polymer may be a polyacrylate homopolymer having a molecular weight of from 4,000 Da to 9,000 Da, or from 6,000 Da to 9,000 Da. Other suitable carboxylate polymers are co-polymers of maleic acid and acrylic acid, and may have a molecular weight in the range of from 4,000 Da to 90,000 Da.

Other suitable carboxylate polymers are co-polymers comprising: (i) from 50 to less than 98 wt % structural units derived from one or more monomers comprising carboxyl groups; (ii) from 1 to less than 49 wt % structural units derived from one or more monomers comprising sulfonate moieties; and (iii) from 1 to 49 wt % structural units derived from one or more types of monomers selected from ether bond-containing monomers represented by formulas (I) and (II):

formula (I):

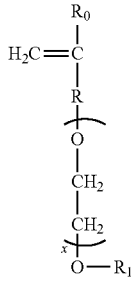

wherein in formula (I), $R_0$ represents a hydrogen atom or $CH_3$ group, R represents a $CH_2$ group, $CH_2CH_2$ group or single bond, X represents a number 0-5 provided X represents a number 1-5 when R is a single bond, and $R_1$ is a hydrogen atom or $C_1$ to $C_{20}$ organic group;

formula (II)

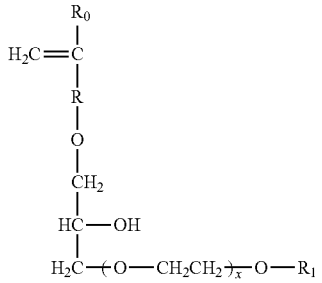

in formula (II), $R_0$ represents a hydrogen atom or $CH_3$ group, R represents a $CH_2$ group, $CH_2CH_2$ group or single bond, X represents a number 0-5, and $R_1$ is a hydrogen atom or $C_1$ to $C_{20}$ organic group.

Polyethylene Glycol Polymer:

Suitable polyethylene glycol polymers include random graft co-polymers comprising: (i) hydrophilic backbone comprising polyethylene glycol; and (ii) hydrophobic side chain(s) selected from the group consisting of: $C_4$-$C_{25}$ alkyl group, polypropylene, polybutylene, vinyl ester of a saturated $C_1$-$C_6$ mono-carboxylic acid, $C_1$-$C_6$ alkyl ester of acrylic or methacrylic acid, and mixtures thereof. Suitable polyethylene glycol polymers have a polyethylene glycol backbone with random grafted polyvinyl acetate side chains. The average molecular weight of the polyethylene glycol backbone can be in the range of from 2,000 Da to 20,000 Da, or from 4,000 Da to 8,000 Da. The molecular weight ratio of the polyethylene glycol backbone to the polyvinyl acetate side chains can be in the range of from 1:1 to 1:5, or from 1:1.2 to 1:2. The average number of graft sites per ethylene oxide units can be less than 1, or less than 0.8, the average number of graft sites per ethylene oxide units can be in the range of from 0.5 to 0.9, or the average number of graft sites per ethylene oxide units can be in the range of from 0.1 to 0.5, or from 0.2 to 0.4. A suitable polyethylene glycol polymer is Sokalan HP22.

Polyester Soil Release Polymers:

Suitable polyester soil release polymers have a structure as defined by one of the following structures (I), (II) or (III):

(I) $—[(OCHR^1—CHR^2)_a—O—OC—Ar—CO—]_d$ (II) $—[(OCHR^3—CHR^4)_b—O—OC\text{-}sAr—CO—]_e$ (III) $—[(OCHR^5—CHR^6)_c—OR^7]_f$ wherein:

a, b and c are from 1 to 200;

d, e and f are from 1 to 50;

Ar is a 1,4-substituted phenylene;

sAr is 1,3-substituted phenylene substituted in position 5 with $SO_3Me$;

Me is H, Na, Li, K, Mg/2, Ca/2, Al/3, ammonium, mono-, di-, tri-, or tetraalkylammonium wherein the alkyl groups are $C_1$-$C_{18}$ alkyl or $C_2$-$C_{10}$ hydroxyalkyl, or any mixture thereof;

$R^1$, $R^2$, $R^3$, $R^4$, $R^5$ and $R^6$ are independently selected from H or $C_1$-$C_{18}$ n- or iso-alkyl; and $R^7$ is a linear or branched $C_1$-$C_{18}$ alkyl, or a linear or branched $C_2$-$C_{30}$ alkenyl, or a cycloalkyl group with 5 to 9 carbon atoms, or a $C_8$-$C_{30}$ aryl group, or a $C_6$-$C_{30}$ arylalkyl group.

Suitable polyester soil release polymers are terephthalate polymers having the structure of formula (I) or (II) above.

Suitable polyester soil release polymers include the Repel-o-tex series of polymers such as Repel-o-tex SF2 (Rhodia) and/or the Texcare series of polymers such as Texcare SRA300 (Clariant).

Amine Polymer:

Suitable amine polymers include polyethylene imine polymers, such as alkoxylated polyalkyleneimines, optionally comprising a polyethylene and/or polypropylene oxide block.

Cellulosic Polymer:

The composition can comprise cellulosic polymers, such as polymers selected from alkyl cellulose, alkyl alkoxyalkyl cellulose, carboxyalkyl cellulose, alkyl carboxyalkyl, and any combination thereof. Suitable cellulosic polymers are selected from carboxymethyl cellulose, methyl cellulose, methyl hydroxyethyl cellulose, methyl carboxymethyl cellulose, and mixtures thereof. The carboxymethyl cellulose can have a degree of carboxymethyl substitution from 0.5 to 0.9 and a molecular weight from 100,000 Da to 300,000 Da. Another suitable cellulosic polymer is hydrophobically modified carboxymethyl cellulose, such as Finnfix SH-1 (CP Kelco).

Other suitable cellulosic polymers may have a degree of substitution (DSub) of from 0.01 to 0.99 and a degree of blockiness (DB) such that either DSub+DB is of at least 1.00 or $DB+2DSub-DSub^2$ is at least 1.20. The substituted cellulosic polymer can have a degree of substitution (DSub) of at least 0.55. The substituted cellulosic polymer can have a degree of blockiness (DB) of at least 0.35. The substituted cellulosic polymer can have a DSub+DB, of from 1.05 to 2.00. A suitable substituted cellulosic polymer is carboxymethylcellulose.

Another suitable cellulosic polymer is cationically modified hydroxyethyl cellulose.

Dye Transfer Inhibitor Polymer:

Suitable dye transfer inhibitor (DTI) polymers include polyvinyl pyrrolidone (PVP), vinyl co-polymers of pyrrolidone and imidazoline (PVPVI), polyvinyl N-oxide (PVNO), and any mixture thereof. Preferably, the dye transfer inhibitor polymers are not present in the same particle as the water-soluble phthalocyanine compound, cross-linked polyvinylpyrrolidone component, or hydrophilic binding agent.

Hexamethylenediamine Derivative Polymers:

Suitable polymers include hexamethylenediamine derivative polymers, typically having the formula:

$$R_2(CH_3)N^+(CH_2)6N^+(CH_3)R_2.2X^-$$

wherein $X^-$ is a suitable counter-ion, for example chloride, and R is a poly(ethylene glycol) chain having an average degree of ethoxylation of from 20 to 30. Optionally, the poly(ethylene glycol) chains may be independently capped with sulphate and/or sulphonate groups, typically with the charge being balanced by reducing the number of $X^-$ counter-ions, or (in cases where the average degree of sulphation per molecule is greater than two), introduction of $Y^+$ counter-ions, for example sodium cations.

Builder:

Suitable builders include zeolites, phosphates, citrates, and any combination thereof.

Zeolite Builder:

The composition may be substantially free of zeolite builder. Substantially free of zeolite builder typically means comprises from 0 wt % to 10 wt %, zeolite builder, or to 8 wt %, or to 6 wt %, or to 4 wt %, or to 3 wt %, or to 2 wt %, or even to 1 wt % zeolite builder. Substantially free of zeolite builder preferably means "no deliberately added" zeolite builder. Typical zeolite builders include zeolite A, zeolite P, zeolite MAP, zeolite X and zeolite Y.

Phosphate Builder:

The composition may be substantially free of phosphate builder. Substantially free of phosphate builder typically means comprises from 0 wt % to 10 wt % phosphate builder, or to 8 wt %, or to 6 wt %, or to 4 wt %, or to 3 wt %, or to 2 wt %, or even to 1 wt % phosphate builder. Substantially free of zeolite builder preferably means "no deliberately added" phosphate builder. A typical phosphate builder is sodium tri-polyphosphate (STPP).

Citrate:

A suitable citrate is sodium citrate. However, citric acid may also be incorporated into the composition, which can form citrate in the wash liquor.

Buffer and Alkalinity Source:

Suitable buffers and alkalinity sources include carbonate salts and/or silicate salts and/or double salts such as burkeitte.

Carbonate Salt:

A suitable carbonate salt is sodium carbonate and/or sodium bicarbonate. The composition may comprise bicarbonate salt. It may be suitable for the composition to comprise low levels of carbonate salt, for example, it may be suitable for the composition to comprise from 0 wt % to 10 wt % carbonate salt, or to 8 wt %, or to 6 wt %, or to 4 wt %, or to 3 wt %, or to 2 wt %, or even to 1 wt % carbonate salt. The composition may even be substantially free of carbonate salt; substantially free means "no deliberately added".

The carbonate salt may have a weight average mean particle size of from 100 to 500 micrometers. Alternatively, the carbonate salt may have a weight average mean particle size of from 10 to 25 micrometers.

Silicate Salt:

The composition may comprise from 0 wt % to 20 wt % silicate salt, or to 15 wt %, or to 10 wt %, or to 5 wt %, or to 4 wt %, or even to 2 wt %, and may comprise from above 0 wt %, or from 0.5 wt %, or even from 1 wt % silicate salt. The silicate can be crystalline or amorphous. Suitable crystalline silicates include crystalline layered silicate, such as SKS-6. Other suitable silicates include 1.6R silicate and/or 2.0R silicate. A suitable silicate salt is sodium silicate. Another suitable silicate salt is sodium metasilicate.

Filler:

The composition may comprise from 0 wt % to 70% filler. Suitable fillers include sulphate salts and/or bio-filler materials.

Sulphate Salt:

A suitable sulphate salt is sodium sulphate. The sulphate salt may have a weight average mean particle size of from 100 to 500 micrometers, alternatively, the sulphate salt may have a weight average mean particle size of from 10 to 45 micrometers.

Bio-Filler Material:

A suitable bio-filler material is alkali and/or bleach treated agricultural waste.

Bleach:

The composition may comprise bleach. Alternatively, the composition may be substantially free of bleach; substantially free means "no deliberately added". Suitable bleach includes bleach activators, sources of available oxygen, pre-formed peracids, bleach catalysts, reducing bleach, and any combination thereof. If present, the bleach, or any component thereof, for example the pre-formed peracid, may be coated, such as encapsulated, or clathrated, such as with urea or cyclodextrin.

Bleach Activator:

Suitable bleach activators include: tetraacetylethylenediamine (TAED); oxybenzene sulphonates such as nonanoyl oxybenzene sulphonate (NOBS), caprylamidononanoyl oxybenzene sulphonate (NACA-OBS), 3,5,5-trimethyl hexanoyloxybenzene sulphonate (Iso-NOBS), dodecyl oxybenzene sulphonate (LOBS), and any mixture thereof; caprolactams; pentaacetate glucose (PAG); nitrile quaternary ammonium; imide bleach activators, such as N-nonanoyl-N-methyl acetamide; and any mixture thereof.

Source of Available Oxygen:

A suitable source of available oxygen (AvOx) is a source of hydrogen peroxide, such as percarbonate salts and/or perborate salts, such as sodium percarbonate. The source of peroxygen may be at least partially coated, or even completely coated, by a coating ingredient such as a carbonate salt, a sulphate salt, a silicate salt, borosilicate, or any mixture thereof, including mixed salts thereof. Suitable percarbonate salts can be prepared by a fluid bed process or by a crystallization process. Suitable perborate salts include sodium perborate mono-hydrate (PB1), sodium perborate tetra-hydrate (PB4), and anhydrous sodium perborate which is also known as fizzing sodium perborate. Other suitable sources of AvOx include persulphate, such as oxone. Another suitable source of AvOx is hydrogen peroxide.

Pre-Formed Peracid:

A suitable pre-formed peracid is N,N-pthaloylamino peroxycaproic acid (PAP).

Bleach Catalyst:

Suitable bleach catalysts include oxaziridinium-based bleach catalysts, transition metal bleach catalysts and bleaching enzymes.

Oxaziridinium-Based Bleach Catalyst:

A suitable oxaziridinium-based bleach catalyst has the formula:

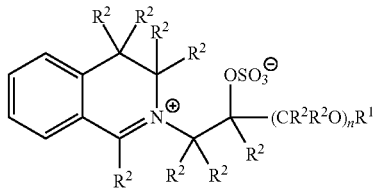

wherein: $R^1$ is selected from the group consisting of: H, a branched alkyl group containing from 3 to 24 carbons, and a linear alkyl group containing from 1 to 24 carbons; $R^1$ can be a branched alkyl group comprising from 6 to 18 carbons, or a linear alkyl group comprising from 5 to 18 carbons, $R^1$ can be selected from the group consisting of: 2-propylheptyl, 2-butyloctyl, 2-pentylnonyl, 2-hexyldecyl, n-hexyl, n-octyl, n-decyl, n-dodecyl, n-tetradecyl, n-hexadecyl, n-octadecyl, iso-nonyl, iso-decyl, iso-tridecyl and iso-pentadecyl; $R^2$ is independently selected from the group consisting of: H, a branched alkyl group comprising from 3 to 12 carbons, and a linear alkyl group comprising from 1 to 12 carbons; optionally $R^2$ is independently selected from H and methyl groups; and n is an integer from 0 to 1.

Transition Metal Bleach Catalyst:

The composition may include transition metal bleach catalyst, typically comprising copper, iron, titanium, ruthenium, tungsten, molybdenum, and/or manganese cations. Suitable transition metal bleach catalysts are manganese-based transition metal bleach catalysts.

Reducing Bleach:

The composition may comprise a reducing bleach. However, the composition may be substantially free of reducing bleach; substantially free means "no deliberately added". Suitable reducing bleach include sodium sulphite and/or thiourea dioxide (TDO).

Co-Bleach Particle:

The composition may comprise a co-bleach particle. Typically, the co-bleach particle comprises a bleach activator and a source of peroxide. It may be highly suitable for a large amount of bleach activator relative to the source of hydrogen peroxide to be present in the co-bleach particle. The weight ratio of bleach activator to source of hydrogen peroxide present in the co-bleach particle can be at least 0.3:1, or at least 0.6:1, or at least 0.7:1, or at least 0.8:1, or at least 0.9:1, or at least 1.0:1.0, or even at least 1.2:1 or higher.

The co-bleach particle can comprise: (i) bleach activator, such as TAED; and (ii) a source of hydrogen peroxide, such as sodium percarbonate. The bleach activator may at least partially, or even completely, enclose the source of hydrogen peroxide.

The co-bleach particle may comprise a binder. Suitable binders are carboxylate polymers such as polyacrylate polymers, and/or surfactants including non-ionic detersive surfactants and/or anionic detersive surfactants such as linear $C_{11}$-$C_{13}$ alkyl benzene sulphonate.

The co-bleach particle may comprise bleach catalyst, such as an oxaziridium based bleach catalyst.

Chelant:

Suitable chelants are selected from: diethylene triamine pentaacetate, diethylene triamine penta(methyl phosphonic acid), ethylene diamine-N'N'-disuccinic acid, ethylene diamine tetraacetate, ethylene diamine tetra(methylene phosphonic acid), hydroxyethane di(methylene phosphonic acid), and any combination thereof. A suitable chelant is ethylene diamine-N'N'-disuccinic acid (EDDS) and/or hydroxyethane diphosphonic acid (HEDP). The laundry detergent composition may comprise ethylene diamine-N'N'-disuccinic acid or salt thereof. The ethylene diamine-N'N'-disuccinic acid may be in S,S enantiomeric form. The composition may comprise 4,5-dihydroxy-m-benzenedisulfonic acid disodium salt. Suitable chelants may also be calcium crystal growth inhibitors.

Calcium Carbonate Crystal Growth Inhibitor:

The composition may comprise a calcium carbonate crystal growth inhibitor, such as one selected from the group consisting of: 1-hydroxyethanediphosphonic acid (HEDP) and salts thereof; N,N-dicarboxymethyl-2-aminopentane-1,5-dioic acid and salts thereof; 2-phosphonobutane-1,2,4-tricarboxylic acid and salts thereof; and any combination thereof.

blue 95, basic blue 122, basic blue 124, basic blue 141, thiazolium dyes, reactive blue 19, reactive blue 163, reactive blue 182, reactive blue 96, Liquitint® Violet CT (Milliken, Spartanburg, USA), Liquitint® Violet DD (Milliken, Spartanburg, USA) and Azo-CM-Cellulose (Megazyme, Bray, Republic of Ireland). A particularly suitable hueing agent is a combination of acid red 52 and acid blue 80, or the combination of direct violet 9 and solvent violet 13. Another suitable hueing dye is described in more detail in WO2010/151906.

Brightener:

Suitable brighteners are stilbenes, such as C.I. fluorescent brightener 351. The brightener may be in micronized particulate form, having a weight average particle size in the range of from 3 to 30 micrometers, or from 3 micrometers to 20 micrometers, or from 3 to 10 micrometers. The brightener can be alpha or beta crystalline form. A preferred brightener is C.I. fluorescent brightener 260 having the following structure:

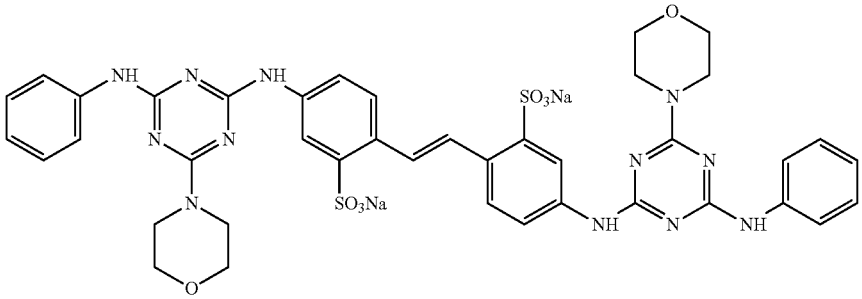

Photobleach:

Suitable photobleaches are zinc and/or aluminium sulphonated phthalocyanines.

Additional Hueing Agent:

Additional hueing agents (also defined herein as hueing dye) are typically formulated to deposit onto fabrics from the wash liquor so as to improve fabric whiteness perception, for example producing a relative hue angle of from 200° to 320° on a garment. Additional hueing agents are typically blue or violet. It may be suitable that the additional hueing dye(s) have a peak absorption wavelength of from 550 nm to 650 nm, or from 570 nm to 630 nm. The additional hueing agents may be a combination of dyes which together have the visual effect on the human eye as a single dye having a peak absorption wavelength on polyester of from 550 nm to 650 nm, or from 570 nm to 630 nm. This may be provided for example by mixing a red and green-blue dye to yield a blue or violet shade.

Dyes are typically coloured organic molecules which are soluble in aqueous media that contain surfactants. Dyes maybe selected from the classes of basic, acid, hydrophobic, direct and polymeric dyes, and dye-conjugates. Suitable polymeric hueing dyes are commercially available, for example from Milliken, Spartanburg, S.C., USA.

Examples of suitable dyes are, direct violet 7, direct violet 9, direct violet 11, direct violet 26, direct violet 31, direct violet 35, direct violet 40, direct violet 41, direct violet 51, direct violet 66, direct violet 99, acid violet 50, acid blue 9, acid violet 17, acid black 1, acid red 17, acid blue 29, acid blue 80, solvent violet 13, disperse violet 27 disperse violet 26, disperse violet 28, disperse violet 63 and disperse violet 77, basic blue 16, basic blue 65, basic blue 66, basic blue 67, basic blue 71, basic blue 159, basic violet 19, basic violet 35, basic violet 38, basic violet 48; basic blue 3, basic blue 75, basic wherein the C.I. fluorescent brightener 260 is either: (i) predominantly in alpha-crystalline form; or (ii) predominantly in beta-crystalline form and having a weight average primary particle size of from 3 to 30 micrometers. As used herein, predominantly typically means "comprises greater than 50 wt % to 100 wt %, or greater than 60 wt %, or greater than 70 wt %, or greater than 80 wt %, or greater than 90 wt % to 100 wt %, or even comprises 100 wt %.

Enzyme:

Suitable enzymes include proteases, amylases, cellulases, lipases, xylogucanases, pectate lyases, mannanases, bleaching enzymes, cutinases, and mixtures thereof.

For the enzymes, accession numbers and IDs shown in parentheses refer to the entry numbers in the databases Genbank, EMBL and/or Swiss-Prot. For any mutations, standard 1-letter amino acid codes are used with a * representing a deletion. Accession numbers prefixed with DSM refer to micro-organisms deposited at Deutsche Sammlung von Mikroorganismen and Zellkulturen GmbH, Mascheroder Weg 1b, 38124 Brunswick (DSMZ).

Protease.

The composition may comprise a protease. Suitable proteases include metalloproteases and/or serine proteases, including neutral or alkaline microbial serine proteases, such as subtilisins (EC 3.4.21.62). Suitable proteases include those of animal, vegetable or microbial origin. In one aspect, such suitable protease may be of microbial origin. The suitable proteases include chemically or genetically modified mutants of the aforementioned suitable proteases. In one aspect, the suitable protease may be a serine protease, such as an alkaline microbial protease or/and a trypsin-type protease. Examples of suitable neutral or alkaline proteases include:

(a) subtilisins (EC 3.4.21.62), including those derived from *Bacillus*, such as *Bacillus lentus, Bacillus alkalophilus* (P27963, ELYA_BACAO), *Bacillus subtilis, Bacillus amyloliquefaciens* (P00782, SUBT_BACAM), *Bacillus pumilus* (P07518) and *Bacillus gibsonii* (DSM14391).

(b) trypsin-type or chymotrypsin-type proteases, such as trypsin (e.g. of porcine or bovine origin), including the *Fusarium* protease and the chymotrypsin proteases derived from *Cellumonas* (A2RQE2).

(c) metalloproteases, including those derived from *Bacillus amyloliquefaciens* (P06832, NPRE_BACAM).

Suitable proteases include those derived from *Bacillus gibsonii* or *Bacillus Lentus* such as subtilisin 309 (P29600) and/or DSM 5483 (P29599).

Suitable commercially available protease enzymes include: those sold under the trade names Alcalase®, Savinase®, Primase®, Durazym®, Polarzyme®, Kannase®, Liquanase®, Liquanase Ultra®, Savinase Ultra®, Ovozyme®, Neutrase®, Everlase® and Esperase® by Novozymes A/S (Denmark); those sold under the tradename Maxatase®, Maxacal®, Maxapem®, Properase®, Purafect®, Purafect Prime®, Purafect Ox®, FN3®, FN4®, Excellase® and Purafect OXP® by Genencor International; those sold under the tradename Opticlean® and Optimase® by Solvay Enzymes; those available from Henkel/Kemira, namely BLAP (P29599 having the following mutations S99D+S101 R+S103A+V104I+G159S), and variants thereof including BLAP R (BLAP with S3T+V4I+V199M+V205I+L217D), BLAP X (BLAP with S3T+V4I+V205I) and BLAP F49 (BLAP with S3T+V4I+A194P+V199M+V205I+L217D) all from Henkel/Kemira; and KAP (*Bacillus alkalophilus* subtilisin with mutations A230V+S256G+S259N) from Kao.

Amylase:

Suitable amylases are alpha-amylases, including those of bacterial or fungal origin. Chemically or genetically modified mutants (variants) are included. A suitable alkaline alpha-amylase is derived from a strain of *Bacillus*, such as *Bacillus licheniformis, Bacillus amyloliquefaciens, Bacillus stearothermophilus, Bacillus subtilis*, or other *Bacillus* sp., such as *Bacillus* sp. NCIB 12289, NCIB 12512, NCIB 12513, sp 707, DSM 9375, DSM 12368, DSMZ no. 12649, KSM AP1378, KSM K36 or KSM K38. Suitable amylases include:

(a) alpha-amylase derived from *Bacillus licheniformis* (P06278, AMY_BACLI), and variants thereof, especially the variants with substitutions in one or more of the following positions: 15, 23, 105, 106, 124, 128, 133, 154, 156, 181, 188, 190, 197, 202, 208, 209, 243, 264, 304, 305, 391, 408, and 444.

(b) AA560 amylase (CBU30457, HD066534) and variants thereof, especially the variants with one or more substitutions in the following positions: 26, 30, 33, 82, 37, 106, 118, 128, 133, 149, 150, 160, 178, 182, 186, 193, 203, 214, 231, 256, 257, 258, 269, 270, 272, 283, 295, 296, 298, 299, 303, 304, 305, 311, 314, 315, 318, 319, 339, 345, 361, 378, 383, 419, 421, 437, 441, 444, 445, 446, 447, 450, 461, 471, 482, 484, optionally that also contain the deletions of D183* and G184*.

(c) variants exhibiting at least 90% identity with the wild-type enzyme from *Bacillus* SP722 (CBU30453, HD066526), especially variants with deletions in the 183 and 184 positions.

Suitable commercially available alpha-amylases are Duramyl®, Liquezyme® Termamyl®, Termamyl Ultra®, Natalase®, Supramyl®, Stainzyme®, Stainzyme Plus®, Fungamyl® and BAN® (Novozymes A/S), Bioamylase® and variants thereof (Biocon India Ltd.), Kemzym® AT 9000 (Biozym Ges. m.b.H, Austria), Rapidase®, Purastar®, Optisize HT Plus®, Enzysize®, Powerase® and Purastar Oxam®, Maxamyl® (Genencor International Inc.) and KAM® (KAO, Japan). Suitable amylases are Natalase®, Stainzyme® and Stainzyme Plus®.

Cellulase:

The composition may comprise a cellulase. Suitable cellulases include those of bacterial or fungal origin. Chemically modified or protein engineered mutants are included. Suitable cellulases include cellulases from the genera *Bacillus, Pseudomonas, Humicola, Fusarium, Thielavia, Acremonium*, e.g., the fungal cellulases produced from *Humicola insolens, Myceliophthora thermophila* and *Fusarium oxysporum.*

Commercially available cellulases include Celluzyme®, and Carezyme® (Novozymes A/S), Clazinase®, and Puradax HA® (Genencor International Inc.), and KAC-500(B)® (Kao Corporation).

The cellulase can include microbial-derived endoglucanases exhibiting endo-beta-1,4-glucanase activity (E.C. 3.2.1.4), including a bacterial polypeptide endogenous to a member of the genus *Bacillus* sp. AA349 and mixtures thereof. Suitable endoglucanases are sold under the tradenames Celluclean® and Whitezyme® (Novozymes A/S, Bagsvaerd, Denmark).

The composition may comprise a cleaning cellulase belonging to Glycosyl Hydrolase family 45 having a molecular weight of from 17 kDa to 30 kDa, for example the endoglucanases sold under the tradename Biotouch® NCD, DCC and DCL (AB Enzymes, Darmstadt, Germany).

Suitable cellulases may also exhibit xyloglucanase activity, such as Whitezyme®.

Lipase.

The composition may comprise a lipase. Suitable lipases include those of bacterial or fungal origin. Chemically modified or protein engineered mutants are included. Examples of useful lipases include lipases from *Humicola* (synonym *Thermomyces*), e.g., from *H. lanuginosa* (*T. lanuginosus*), or from *H. insolens*, a *Pseudomonas lipase*, e.g., from *P. alcaligenes* or *P. pseudoalcaligenes, P. cepacia, P. stutzeri, P. fluorescens, Pseudomonas* sp. strain SD 705, *P. wisconsinensis*, a *Bacillus lipase*, e.g., from *B. subtilis, B. stearothermophilus* or *B. pumilus.*

The lipase may be a "first cycle lipase", optionally a variant of the wild-type lipase from *Thermomyces lanuginosus* comprising T231R and N233R mutations. The wild-type sequence is the 269 amino acids (amino acids 23-291) of the Swissprot accession number Swiss-Prot 059952 (derived from *Thermomyces lanuginosus* (*Humicola lanuginosa*)). Suitable lipases would include those sold under the tradenames Lipex®, Lipolex® and Lipoclean® by Novozymes, Bagsvaerd, Denmark.

The composition may comprise a variant of *Thermomyces lanuginosa* (O59952) lipase having >90% identity with the wild type amino acid and comprising substitution(s) at T231 and/or N233, optionally T231R and/or N233R.

Xyloglucanase:

Suitable xyloglucanase enzymes may have enzymatic activity towards both xyloglucan and amorphous cellulose substrates. The enzyme may be a glycosyl hydrolase (GH) selected from GH families 5, 12, 44 or 74. The glycosyl hydrolase selected from GH family 44 is particularly suitable. Suitable glycosyl hydrolases from GH family 44 are the XYG1006 glycosyl hydrolase from *Paenibacillus* polyxyma (ATCC 832) and variants thereof.

Pectate Lyase:

Suitable pectate lyases are either wild-types or variants of *Bacillus* derived pectate lyases (CAF05441, AAU25568) sold under the tradenames Pectawash®, Pectaway® and X-Pect® (from Novozymes A/S, Bagsvaerd, Denmark).

Mannanase:

Suitable mannanases are sold under the tradenames Mannaway® (from Novozymes A/S, Bagsvaerd, Denmark), and Purabrite® (Genencor International Inc., Palo Alto, Calif.).

Bleaching Enzyme:

Suitable bleach enzymes include oxidoreductases, for example oxidases such as glucose, choline or carbohydrate oxidases, oxygenases, catalases, peroxidases, like halo-, chloro-, bromo-, lignin-, glucose- or manganese-peroxidases, dioxygenases or laccases (phenoloxidases, polyphenoloxidases). Suitable commercial products are sold under the Guardzyme® and Denilite® ranges from Novozymes. It may be advantageous for additional organic compounds, especially aromatic compounds, to be incorporated with the bleaching enzyme; these compounds interact with the bleaching enzyme to enhance the activity of the oxidoreductase (enhancer) or to facilitate the electron flow (mediator) between the oxidizing enzyme and the stain typically over strongly different redox potentials.

Other suitable bleaching enzymes include perhydrolases, which catalyse the formation of peracids from an ester substrate and peroxygen source. Suitable perhydrolases include variants of the *Mycobacterium smegmatis* perhydrolase, variants of so-called CE-7 perhydrolases, and variants of wild-type subtilisin Carlsberg possessing perhydrolase activity.

Cutinase:

Suitable cutinases are defined by E.C. Class 3.1.1.73, optionally displaying at least 90%, or 95%, or most optionally at least 98% identity with a wild-type derived from one of *Fusarium solani, Pseudomonas Mendocina* or *Humicola Insolens*.

Identity.

The relativity between two amino acid sequences is described by the parameter "identity". For purposes of the present invention, the alignment of two amino acid sequences is determined by using the Needle program from the EMBOSS package (http://emboss.org) version 2.8.0. The Needle program implements the global alignment algorithm described in Needleman, S. B. and Wunsch, C. D. (1970) J. Mol. Biol. 48, 443-453. The substitution matrix used is BLOSUM62, gap opening penalty is 10, and gap extension penalty is 0.5.

Fabric-Softener:

Suitable fabric-softening agents include clay, silicone and/or quaternary ammonium compounds. Suitable clays include montmorillonite clay, hectorite clay and/or laponite clay. A suitable clay is montmorillonite clay. Suitable silicones include amino-silicones and/or polydimethylsiloxane (PDMS). A suitable fabric softener is a particle comprising clay and silicone, such as a particle comprising montmorillonite clay and PDMS.

Flocculant:

Suitable flocculants include polyethylene oxide; for example having an average molecular weight of from 300,000 Da to 900,000 Da.

Suds Suppressor:

Suitable suds suppressors include silicone and/or fatty acid such as stearic acid.

Perfume:

Suitable perfumes include perfume microcapsules, polymer assisted perfume delivery systems including Schiff base perfume/polymer complexes, starch encapsulated perfume accords, perfume-loaded zeolites, blooming perfume accords, and any combination thereof. A suitable perfume microcapsule is melamine formaldehyde based, typically comprising perfume that is encapsulated by a shell comprising melamine formaldehyde. It may be highly suitable for such perfume microcapsules to comprise cationic and/or cationic precursor material in the shell, such as polyvinyl formamide (PVF) and/or cationically modified hydroxyethyl cellulose (catHEC).

Aesthetic:

Suitable aesthetic particles include soap rings, lamellar aesthetic particles, geltin beads, carbonate and/or sulphate salt speckles, coloured clay particles, and any combination thereof.

Method of Laundering Fabric:

The method of laundering fabric typically comprises the step of contacting the composition to water to form a wash liquor, and laundering fabric in said wash liquor, wherein typically the wash liquor has a temperature of above 0° C. to 90° C., or to 60° C., or to 40° C., or to 30° C., or to 20° C., or to 10° C., or even to 8° C. The fabric may be contacted to the water prior to, or after, or simultaneous with, contacting the laundry detergent composition with water. The composition can be used in pre-treatment applications.

Typically, the wash liquor is formed by contacting the laundry detergent to water in such an amount so that the concentration of laundry detergent composition in the wash liquor is from above 0 g/1 to 10 g/l, or from 1 g/l, and to 9 g/l, or to 8.0 g/l, or to 7.0 g/l, or to 6.0 g/l, or to 4 g/l, or even to 3.0 g/l, or even to 2.5 g/1.

The method of laundering fabric may be carried out in a top-loading or front loading automatic washing machine, or can be used in a hand-wash laundry application. In these applications, the wash liquor formed and concentration of laundry detergent composition in the wash liquor is that of the main wash cycle. Any input of water during any optional rinsing step(s) is not included when determining the volume of the wash liquor.

The wash liquor may comprise 80 liters or less of water, or 60 liters or less, or 40 liters or less, or 20 liters or less, or 8 liters or less, or even 6 liters or less of water. The wash liquor may comprise from above 0 to 15 liters, or from 2 liters, and to 12 liters, or even to 8 liters of water.

Typically from 0.01 kg to 2 kg of fabric per liter of wash liquor is dosed into said wash liquor. Typically from 0.01 kg, or from 0.05 kg, or from 0.07 kg, or from 0.10 kg, or from 0.15 kg, or from 0.20 kg, or from 0.25 kg fabric per liter of wash liquor is dosed into said wash liquor.

Optionally, 150 g or less, 100 g or less, 50 g or less, or 45 g or less, or 40 g or less, or 35 g or less, or 30 g or less, or 25 g or less, or 20 g or less, or even 15 g or less, or even 10 g or less of the composition is contacted to water to form the wash liquor.

EXAMPLES

1. Preparation of zinc phthalocyanine sulphonic acid conjugate with 4,4'-[[6-[(3-aminophenyl)amino]-1,3,5-triazine-2,4-diyl]diimino]bis[5-hydroxy-6-[2-(1-naphthalenyl)diazenyl]-2,7-naphthalenedisulphonic acid (CAS-No. 1159843-59-0)

a) Acetylation of H-Acid 191.9 g (0.5 mol) 4-amino-5-hydroxy-naphthalene-2,7-disulphonic acid (83%, CAS-No. 90-20-0) are suspended in 500 ml water and dissolved at pH 7 by addition of 48.6 ml aqueous NaOH (30%). 92.1 g acetic acid anhydride are slowly added within 10 minutes. The reaction mixture is cooled to 10° C. by addition of 250.0 g ice. A pH-level of 7 is adjusted by addition of 118.3 ml aqueous NaOH (30%). 56.2 ml aqueous NaOH (30%) are added subsequently. A pH-level of 10.5 is maintained for 1 hour at a temperature of 30° C. by addition of 4.8 ml aqueous NaOH (30%). By addition of 32.9 ml aqueous HCl (32%) the solution is adjusted to a pH-level of 7.2. After cooling to 20° C. with 180 g ice, 1594 g solution of acetylated H-acid (ca. 0.5 mol) is obtained.

b) Diazotation and Coupling of 1-Naphthylamine 57.3 g (0.4 mol) 1-naphthylamine is added with stirring as a melt to a mixture of 800 ml water and 40.0 ml aqueous HCl (32%). Aqueous HCl (97.2 ml, 32%) is added, and the solution is cooled to 0° C. with 530 g ice. 90 ml of aqueous sodium nitrite (4N) is added within 15 minutes. During the addition, the temperature is maintained below 4° C. After further addition of 11 ml aqueous sodium nitrite, the reaction mixture is stirred for 30 minutes. 1 Mol of sulphamic acid is added subsequently to decompose any remaining nitrite.

To the suspension thus obtained, 1275.0 g (0.4 mol) of the acetylated H-acid (pH 4.8) prepared as described above under a) is poured within a minute. A pH-level of 7.5 is adjusted with 327 ml of aqueous sodium carbonate solution (20% w/v). The solution is stirred at room temperature for 12 hours. The total volume of reaction solution is about 3.4 l. For hydrolysis, 340 ml aqueous NaOH (30%) are added to the reaction mixture, followed by heating to 90° C. for 3 hours. A pH-level of 7.5 is adjusted by the addition of 292.5 ml of aqueous HCl (32%). The violet suspension is stirred at room temperature for 12 hours. The volume of the reaction solution is about 4 l. The formed precipitate is filtered off to yield 518.7 g (84.4%) 5-amino-4-hydroxy-3-[2-(1-naphthalenyl) diazenyl]-2,7-naphthalenedisulphonic acid (CAS-No. 103787-67-3) as a paste.

c) Preparation of 4,4'-[[6-[(3-aminophenyl)amino]-1, 3,5-triazine-2,4-diyl]diimino]bis[5-hydroxy-6-[2-(1-naphthalenyl)diazenyl]-2,7-naphthalenedisulphonic acid ("Dye", CAS-No. 1159843-59-0)

An aqueous solution of 0.060 mol 5-amino-4-hydroxy-3 (naphthalene-1-ylazo)-naphthalene-2,7-disulphonic acid is stirred at room temperature. A suspension consisting of 100 ml of ice water, 0.1 g disodium hydrogen tetraoxophosphate and 5.53 g (0.03 mol) cyanuric chloride is added. The reaction mixture is adjusted with aqueous NaOH (30%) and maintained at pH 7. After 30 minutes, the reaction mixture is heated to 70° C. and maintained at a pH-level of 7 for several hours until the coupling reaction with cyanuric chloride is complete as indicated by LC.

To this solution (ca. 0.030 mol intermediate), a solution of 5.59 g (0.0031 mol) m-phenylenediamine dihydrochloride in 50 ml water is added. The reaction mixture is heated to 95° C. A pH value of 8.5 is maintained by addition of aqueous NaOH (30%). The reaction is monitored by LC. After 3 hours, the reaction mixture is cooled to room temperature and a volume of 950 ml solution is obtained. For isolation of the product, 237.5 g sodium chloride is added. The reaction mixture is stirred for another 12 hours. The formed precipitate is filtered off and dried to give 42.2 g dye (UVvis λmax: 536 nm).

d) Sulphonation and Sulphonyl Chloride Formation of Zinc(II) Phthalocyanine (Mono- and Bis-Sulphonated Zinc Phthalocyanines)

Oleum (2500 g, 10%) is warmed up and stirred at 46° C. 500 g (0.87 mol) zinc phthalocyanine is added in portions within one hour. The reaction mixture is heated to 80° C. and stirred for 24 hours at that temperature. Heating is discontinued and the reaction mass is slowly poured into 4000 g of an ice/water mixture. By the addition of sodium hydroxide solution (30%), the suspension is adjusted to pH 7 while keeping the temperature between 15-25° C. by external cooling. The mixture is stirred for another eight hours and the pH is adjusted to a value of 7 again. The formed precipitate is filtered off, washed twice with water (2 liters) and dried in vacuum at 55° C. to give a mixture of essentially mono- and bis-sulphonated zinc phthalocyanines (608 g, 86% yield) as a dark blue solid.

142.5 g of this dry mixture is slowly added to 680 ml (1190 g, 10.2 mol) chlorosulphuric acid. The reaction mixture is heated to 84-87° C. and maintained at this temperature for 30 minutes. 80 ml (131.2 g, 1.103 mol) thionyl chloride is added dropwise within one hour and stirring is continued for another two hours. External heating is discontinued and the reaction mixture is poured into 9000 g of a water/ice mixture. The formed precipitate is filtered off and washed with 200 ml water to give a crude mixture of sulphonyl chlorides.

e) Preparation of Zinc(II) Phthalocyanine Dye Conjugate

The crude filter cake prepared as given above under d) (approx. 0.2 mol) is suspended in a freshly prepared ice-cold water/dimethoxyethane 1:1 (v/v; 4 liters) mixture. The reaction solution is immediately adjusted to pH 4-5 with aqueous NaOH. The dye prepared as given above under c) (226 g, 0.2 mol) is dissolved in 21 water and added with stirring. The reaction mixture is stirred for 25° C. for 12 hours. The reaction mixture is maintained at a pH-level of 7 with aqueous NaOH (32%). The reaction mixture is monitored by TLC and LC. Optionally, the reaction mixture is heated to 50° C. to ensure complete conversion.

The mixture is evaporated to dryness under vacuum at 60-70° C. to remove organic volatiles. The dye conjugate is diluted with water to a concentration of 10.5% w/w with respect to the dry weight (of which NaCl=11.7%, Na2SO4=16.11% and residual H2O=4.9% w/w; equals to 7.14% w/w total active material); main conjugate signals in ESI-MS [M+]: 1767 and 1847 along with minor amounts of 1927).

2. Test Methods a) Spotting Tests

The encapsulated zinc(II) phthalocyanine dye conjugate of each of the Examples given under 3 are weighted into a detergent and then thoroughly mixed using a turbula laboratory mixer until a homogenous distribution in the ECE 77 detergent is achieved (ECE reference detergent 77, from EMPA Test Materials). A concentration of 200 ppm of active dye conjugate is chosen for all tests.

The spotting test used for evaluation of the encapsulated zinc(II) phthalocyanine dye conjugate is outlined in WO 2003/018740. Six 15×15 cm pieces of white bleached woven non-mercerised cotton are placed flat on the bottom of a bowl containing 1 l of tap water. 10 g of ECE 77 detergent, containing the encapsulated dye conjugates of the respective Examples given under 3 are spread on the cloth and then left for 10 minutes. Then the cloth is thoroughly rinsed, dried and then evaluated on a scale ranging from 1 (no discoloration of the fabric, no spots) to 5 (full spotting).

b) Wash Performance (Exhaustion onto Cotton Fabrics)

Bleached cotton is washed for 15 minutes at 30° C. with ECE 77 detergent at a 20 g/kg fabric and a liquor ratio of 1:20, in the presence of each of the encapsulated zinc(II) phthalocyanine dye conjugate of the Examples given under 3 (concentration of 20 mg/l) in LINITEST equipment (Atlas). Before the addition of cotton, the composition is allowed to stand for 1 minute at ambient temperature. After rinsing with tap water, spin-drying and ironing, the exhaustion of the active dye on the fabric is measured by reflectance spectroscopy by using the Kubelka/Munk formula K/S at 560 nm Each K/S-value given in the Examples under 3 represents the K/S-value of the corresponding Example, from which the K/S-value determined for the corresponding encapsulate comprising no zinc(II) phthalocyanine dye conjugate, has been subtracted. The higher the so obtained K/S-value, the higher the exhaustion of the dye conjugate on the cotton fabric, i.e. its hueing ability.

3. Encapsulated Dye Conjugates

Example 1

Encapsulated Dye Conjugate Product with Gelatine of Bloom 11

30 g gelatine of bloom 106 and 270 g gelatine of bloom 0 were dissolved in 875 g of the zinc(II) phthalocyanine dye conjugate solution obtained according to 1 e) at 62° C. under agitation. After 120 minutes, 45 g of coconut oil was added to the aqueous solution under slow agitation. The resulting mixture was then vigorously emulsified for 30 minutes while maintaining the temperature of around 60° C. The resulting dispersion was diluted with 350 g water.

Subsequently the diluted dispersion was atomized into a spray drying tower at about 80° C., where the dispersion particles were covered with a thin layer of powdering starch and dried at 40° C. for 150 minutes.

The resulting dry powder was sieved and the fraction 120 mesh to 60 mesh (ASTM E 11-70 (1995)) was collected and tested.

The final product had the following characteristics:
Bloom: 11, Spotting performance: 4, Wash performance: K/S=0.014

Example 2

Encapsulated Dye Conjugate Product with Gelatine of Bloom 21

60 g gelatine of bloom 106 and 240 g gelatine of bloom 0 were dissolved in 1050 g of the zinc(II) phthalocyanine dye conjugate solution obtained according to 1 e) at 62° C. under agitation. After 120 minutes, 45 g of coconut oil was added to the aqueous solution under slow agitation. The resulting mixture was then vigorously emulsified for 30 minutes while maintaining the temperature of around 60° C. The resulting dispersion was diluted with 350 g water.

Subsequently the diluted dispersion was atomized into a spray drying tower at about 80° C., where the dispersion particles were covered with a thin layer of powdering starch and dried at 40° C. for 150 minutes.

The resulting dry powder was sieved and the fraction 120 mesh to 60 mesh (ASTM E 11-70 (1995)) was collected and tested.

The final product had the following characteristics:
Bloom: 21, Spotting performance: 3.5, Wash performance: K/S=0.014

Example 3

Encapsulated Dye Conjugate Product with Gelatine of Bloom 32

90 g gelatine of bloom 106 and 210 g gelatine of bloom 0 were dissolved in 1250 g of the zinc(II) phthalocyanine dye conjugate solution obtained according to 1 e) at 62° C. under agitation. After 120 minutes, 45 g of coconut oil was added to the aqueous solution under slow agitation. The resulting mixture was then vigorously emulsified for 30 minutes while maintaining the temperature of around 60° C. The resulting dispersion was diluted with 480 g water.

Subsequently the diluted dispersion was atomized into a spray drying tower at about 80° C., where the dispersion particles were covered with a thin layer of powdering starch and dried at 40° C. for 150 minutes.

The resulting dry powder was sieved and the fraction 120 mesh to 60 mesh (ASTM E 11-70 (1995)) was collected and tested.

The final product had the following characteristics:
Bloom: 32, Spotting performance: 3, Wash performance: K/S=0.016

Example 4

Encapsulated Dye Conjugate Product with Gelatine of Bloom 48

135 g gelatine of bloom 106 and 165 g gelatine of bloom 0 were dissolved in 900 g of the zinc(II) phthalocyanine dye conjugate solution obtained according to 1 e) at 62° C. under agitation. After 120 minutes, 45 g of coconut oil was added to the aqueous solution under slow agitation. The resulting mixture was then vigorously emulsified for 30 minutes while maintaining the temperature of around 60° C. The resulting dispersion was diluted with 930 g water.

Subsequently the diluted dispersion was atomized into a spray drying tower at about 80° C., where the dispersion particles were covered with a thin layer of powdering starch and dried at 40° C. for 150 minutes.

The resulting dry powder was sieved and the fraction 120 mesh to 60 mesh (ASTM E 11-70 (1995)) was collected and tested.

The final product had the following characteristics:
Bloom: 48, Spotting performance: 4.5, Wash performance: K/S=0.013

Comparative Example

Encapsulated Dye Conjugate Product with Gelatine of Bloom 0

300 g gelatine of bloom 0 was dissolved in 750 g of the zinc(II) phthalocyanine dye conjugate solution obtained according to 1 e) at 62° C. under agitation. After 120 minutes, 45 g of coconut oil was added to the aqueous solution under slow agitation. The resulting mixture was then vigorously emulsified for 30 minutes while maintaining the temperature of around 60° C. The resulting dispersion was diluted with 350 g water.

Subsequently the diluted dispersion was atomized into a spray drying tower at about 80° C., where the dispersion particles were covered with a thin layer of powdering starch and dried at 40° C. for 150 minutes.

The resulting dry powder was sieved and the fraction 120 mesh to 60 mesh (ASTM E 11-70 (1995)) was collected and tested.

The final product had the following characteristics:

Bloom: 0, Spotting performance: 5, Wash performance: K/S=0.013

In the above Examples 1 to 4 and the Comparative Example the following gelatine grades were used:

Gelatine Bloom 0: "Rousselot ASF" of Rousselot NV, Gent, Belgium

Gelatine Bloom 106: "Gelatine 106 bloom" by PB Gelatins, Vilvorde, Belgium

The above Examples demonstrate that a higher value of the bloom strength of the gelatine results in encapsulated zinc(II) phthalocyanine dye conjugates having better properties with respect to spotting performance and good wash performance, when compared with corresponding encapsulated zinc(II) phthalocyanine dye conjugates prepared by use of gelatine having a bloom strength of 0.

Example 5

Granular Detergent Formulations Comprising the Inventive Particle Comprising a Phthalocyanine Complex

| Ingredient | Amount (in wt %) |
|---|---|
| Anionic detersive surfactant (such as alkyl benzene sulphonate, alkyl ethoxylated sulphate and mixtures thereof) | from 8 wt % to 15 wt % |
| Non-ionic detersive surfactant (such as alkyl ethoxylated alcohol) | from 0.5 wt % to 4 wt % |
| Cationic detersive surfactant (such as quaternary ammonium compounds) | from 0 to 4 wt % |
| Other detersive surfactant (such as zwiterionic detersive surfactants, amphoteric surfactants and mixtures thereof) | from 0 wt % to 4 wt % |
| Carboxylate polymer (such as co-polymers of maleic acid and acrylic acid) | from 1 wt % to 4 wt % |
| Polyethylene glycol polymer (such as a polyethylene glycol polymer comprising poly vinyl acetate side chains) | from 0.5 wt % to 4 wt % |
| Polyester soil release polymer (such as Repel-o-tex and/or Texcare polymers) | from 0.1 to 2 wt % |
| Cellulosic polymer (such as carboxymethyl cellulose, methyl cellulose and combinations thereof) | from 0.5 wt % to 2 wt % |
| Other polymer (such as amine polymers, dye transfer inhibitor polymers, hexamethylenediamine derivative polymers, and mixtures thereof) | from 0 wt % to 4 wt % |
| Zeolite builder and phosphate builder (such as zeolite 4A and/or sodium tripolyphosphate) | from 0 wt % to 4 wt % |
| Other builder (such as sodium citrate and/or citric acid) | from 0 wt % to 3 wt % |
| Carbonate salt (such as sodium carbonate and/or sodium bicarbonate) | from 15 wt % to 30 wt % |
| Silicate salt (such as sodium silicate) | from 0 wt % to 10 wt % |
| Filler (such as sodium sulphate and/or bio-fillers) | from 10 wt % to 60 wt % |
| Source of available oxygen (such as sodium percarbonate) | from l0 wt % to 20 wt % |
| Bleach activator (such as tetraacetylethylene diamine (TAED) and/or nonanoyloxybenzenesulphonate (NOBS) | from 2 wt % to 8 wt % |
| Bleach catalyst (such as oxaziridinium-based bleach catalyst and/or transition metal bleach catalyst) | from 0 wt % to 0.1 wt % |
| Other bleach (such as reducing bleach and/or pre-formed peracid) | from 0 wt % to 10 wt % |
| Chelant (such as ethylenediamine-N'N'-disuccinic acid (EDDS) and/or hydroxyethane diphosphonic acid (HEDP) | from 0.2 wt % to 1 wt % |
| Photobleach (such as zinc and/or aluminium sulphonated phthalocyanine) | from 0 wt % to 0.1 wt % |
| Hueing agent (such as direct violet 99, acid red 52, acid blue 80, direct violet 9, solvent violet 13 and any combination thereof) | from 0 wt % to 1 wt % |
| Inventive particle comprising a phthalocyanine complex (according to the present invention) | from 0.0001 wt % to 1 wt % |
| Brightener (such as C.I. Fluorescent Brightener 260 and/or C.I. Fluorescent Brightener 351) | from 0.1 wt % to 0.4 wt % |
| Protease (such as Savinase, Savinase Ultra, Purafect, FN3, FN4 and any combination thereof) | from 0.1 wt % to 0.4 wt % |
| Amylase (such as Termamyl, Termamyl ultra, Natalase, Optisize, Stainzyme, Stainzyme Plus and any combination thereof) | from 0.05 wt % to 0.2 wt % |
| Cellulase (such as Carezyme and/or Celluclean) | from 0.05 wt % to 0.2 wt % |
| Lipase (such as Lipex, Lipolex, Lipoclean and any combination thereof) | from 0.2 to 1 wt % |
| Other enzyme (such as xyloglucanase, cutinase, pectate lyase, mannanase, bleaching enzyme) | from 0 wt % to 2 wt % |
| Fabric softener (such as montmorillonite clay and/or polydimethylsiloxane (PDMS) | from 0 wt % to 4 wt % |

-continued

| Ingredient | Amount (in wt %) |
|---|---|
| Flocculant (such as polyethylene oxide) | from 0 wt % to 1 wt % |
| Suds suppressor (such as silicone and/or fatty acid) | from 0 wt % to 0.1 wt % |
| Perfume (such as perfume microcapsule, spray-on perfume, starch encapsulated perfume accords, perfume loaded zeolite, and any combination thereof) | from 0.1 wt % to 1 wt % |
| Aesthetics (such as coloured soap rings and/or coloured speckles/noodles) | from 0 wt % to 1 wt % |
| Miscellaneous | balance |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. A laundry detergent composition comprising encapsulated phthalocyanine particles, said particles comprising a) at least one water-soluble phthalocyanine compound, and b) gelatine having a bloom strength of 8 to 50 as encapsulating material.

2. A composition according to claim 1, wherein the particles comprise a) 0.1-20 wt.-% of at least one water-soluble phthalocyanine compound;

b) 5-60 wt.-% of gelatine having a bloom strength of 8 to 50;

c) 0-10 wt.-% of an oil, d) 0-90 wt.-% of a powdering agent, e) 0-90 wt.-% of further additives suitable for the preparation of solid agglomerates, and f) 0-15 wt.-% of water, provided that the sum of components a), b), c), d), e) and f) amounts up to 100 wt.-%.

3. A composition according to claim 1 wherein the particles comprise a) 1-15 wt.-% of at least one water-soluble phthalocyanine compound;

b) 5-50 wt.-% of gelatine having a bloom strength of 8 to 50;

c) 0.1-5 wt.-% of an oil, d) 1-90 wt.-% of a powdering agent, e) 0-90 wt.-% of further additives suitable for the preparation of solid agglomerates, and f) 0.1-15 wt.-% of water, provided that the sum of components a), b), c), d), e) and f) amounts up to 100 wt.-%.

4. A composition according to claim 1 wherein the particles comprise, as water-soluble phthalocyanine compound a), at least one phthalocyanine complex compound of the formula (PC)-L-(D) (1), to which the substituent of at least one mono-azo dye is attached by the linking group L, Wherein PC represents the Zn(II), Fe(II), Ca(II), Mg(II), Na(I), K(I), Al, Si(IV), P(V), Ti(IV) or Cr(VI) metal-containing phthalocyanine structure;

D represents the substituent of a mono-azo dye; and

L represents a group

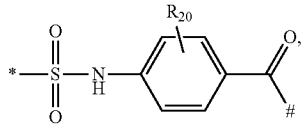

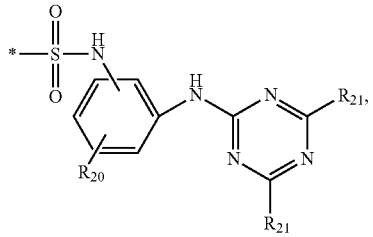

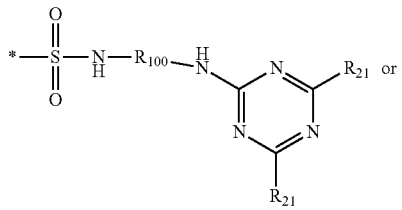

-continued

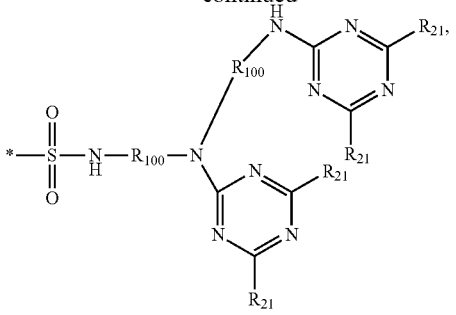

wherein $R_{20}$ represents hydrogen, $C_1$-$C_8$alkyl, $C_1$-$C_8$alkoxy or halogen;

$R_{21}$ represents D, hydrogen, OH, Cl or F, provided that at least one is D;

$R_{100}$ represents $C_1$-$C_8$alkylene;

* marks the point of attachment of PC; and # marks the point of attachment of the substituent D of the mono-azo dye.

5. A composition according to claim 4, wherein the water-soluble phthalocyanine complex compound (1) corresponds to the formula (1a)

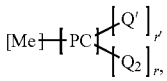

wherein

PC represents the porphyrine structure,

Me represents the central metal atom or central metal group coordinated to PC, which is selected from the group consisting of Zn, Fe, Ca, Mg, Na, K, Al—$Z_1$, Si(IV)-$(Z_1)_2$, Ti(IV)-$(Z_1)_2$ and Sn(IV)-$(Z_1)_2$;

$Z_1$ represents $C_1$-$C_8$alkanolate, $OH^-$, $R_0COO^-$, $ClO_4^-$, $BF_4^-$, $PF_6^-$, $R_0SO_3^-$, $SO_4^{2-}$, $NO_3^-$, $F^-$, $Cl^-$, $Br^-$, $I^-$, citrate, tartrate or oxalate, wherein $R_0$ is hydrogen or $C_1$-$C_{18}$alkyl;

r represents 0 or a numeral from 1 to 3;

r' represents a numeral from 1 to 4;

each $Q_2$ independently of one another represents —$SO_3^-M^+$ or the group —$(CH_2)_m$—$COO^-M^+$; wherein $M^+$ is $H^+$, an alkali metal ion or the ammonium ion and m is 0 or a numeral from 1 to 12;

each Q' independently of one another represents the segment of the partial formula -L-D, Wherein D represents the substituent of a mono-azo dye; and L represents a group

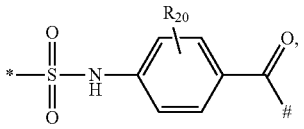

-continued

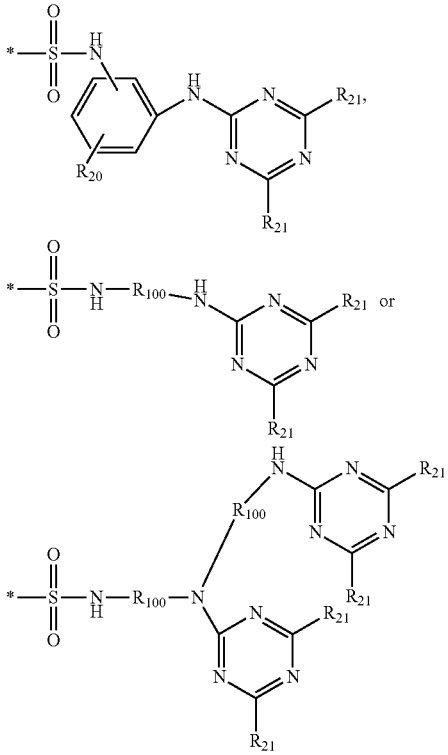

wherein $R_{20}$ represents hydrogen, $C_1$-$C_8$alkyl, $C_1$-$C_8$alkoxy or halogen;

$R_{21}$ represents D, hydrogen, OH, Cl or F, provided that at least one of $R_{21}$ is D;

$R_{100}$ represents $C_1$-$C_8$alkylene;

* marks the point of attachment of Me-PC; and # marks the point of attachment of the substituent D of the mono-azo dye.

6. A composition according to claim 4, wherein the water-soluble phthalocyanine complex compound (1) corresponds to the formula (2a)

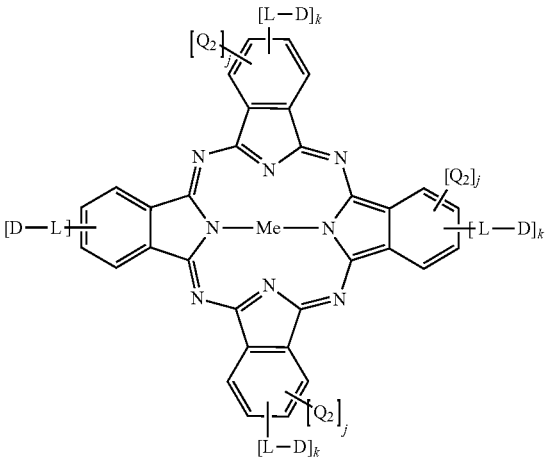

wherein

Me represents Zn, Al—$Z_1$, Si(IV)-$(Z_1)_2$ or Ti(IV)-$(Z_1)_2$, wherein $Z_1$ is chloride, fluoride, bromide or hydroxide;

each $Q_2$ independently of one another represents $—SO_3^-M^+$ or the group $—(CH_2)_m—COO^-M^+$, wherein $M^+$ is $H^+$, an alkali metal ion or the ammonium ion and m is 0 or a numeral from 1 to 12;

each k is independently selected from 0 and 1, each j is independently selected from 0 and 1-k, D represents the substituent of a mono-azo dye; and L represents a group

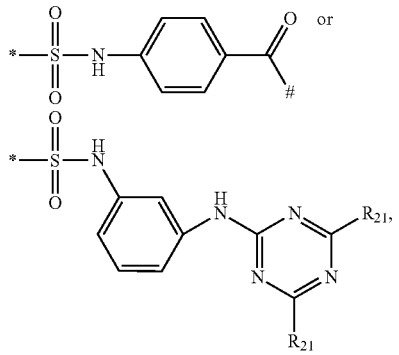

wherein $R_{21}$ represents D, hydrogen, OH, Cl or F, provided that at least one is D;

* marks the point of attachment of PC; and # marks the point of attachment to D.

7. A composition according to claim 4, wherein the water-soluble phthalocyanine complex compound (1) corresponds to the formula

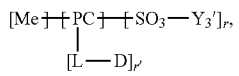

(3a)

wherein

PC, L and D are as defined in claim 4;

Me is Zn or Al—$Z_1$, $Z_1$ is chlorine, fluorine, bromine or hydroxy;

$Y_3'$ is hydrogen; an alkali metal ion or ammonium ion;

r is zero or a numeral from 1-3; and r' is a numeral from 1 to 4.

8. A composition according to claim 6, wherein Me represents Zn.

9. A composition according to claim 4, wherein D represents the substituent of a mono-azo dye of the partial formulae Xa, Xb, Xc or Xd:

(Xa)

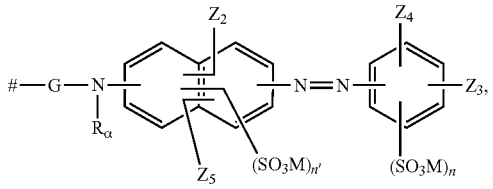

-continued (Xb)

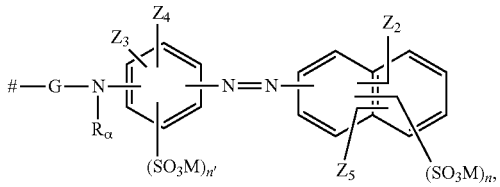

(Xc)

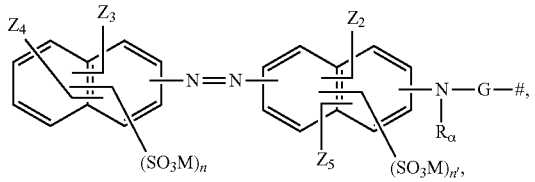

(Xd)

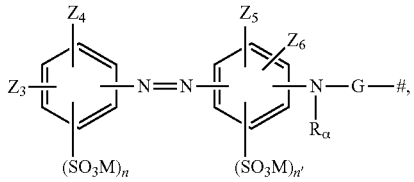

wherein # marks the point of attachment of the bridging group L;

$R_\alpha$ represents hydrogen, $C_1$-$C_4$alkyl, $C_1$-$C_2$alkyl which is substituted by at least one substituent selected from the group consisting of hydroxy, cyano, $SO_3H$, $NH_2$, carboxy, carbo-$C_1$-$C_4$alkoxy, $C_1$-$C_4$alkoxy, phenyl, naphthyl and pyridyl, straight chain or branched $C_3$-$C_4$-alkyl which is substituted by at least one substituent selected from the group consisting of hydroxy, cyano, $SO_3H$, $NH_2$, carboxy, carbo-$C_1$-$C_4$alkoxy, $C_1$-$C_4$alkoxy, phenyl, naphthyl and pyridyl, aryl, aryl which is substituted by at least one substituent selected from the group consisting of hydroxy, cyano, $SO_3H$, $NH_2$, carboxy, carbo-$C_1$-$C_4$alkoxy, $C_1$-$C_4$alkoxy and $C_1$-$C_4$alkyl;

$Z_2$, $Z_3$, $Z_4$, $Z_5$ and $Z_6$ independently of one another represent hydrogen, hydroxy, $C_1$-$C_4$alkyl, $C_1$-$C_2$alkyl which is substituted by at least one substituent selected from the group consisting of hydroxy, cyano, $SO_3H$, $NH_2$, carboxy, carbo-$C_1$-$C_4$alkoxy, $C_1$-$C_4$alkoxy, phenyl, naphthyl and pyridyl, straight chain or branched $C_3$-$C_4$-alkyl which is substituted by at least one substituent selected from the group consisting of hydroxy, cyano, $SO_3H$, $NH_2$, carboxy, carbo-$C_1$-$C_4$alkoxy, $C_1$-$C_4$alkoxy, phenyl, naphthyl and pyridyl, $C_1$-$C_4$alkoxy, $C_1$-$C_2$alkoxy which is substituted by at least one substituent selected from the group consisting of hydroxy, cyano, $SO_3H$, $NH_2$, carboxy, carbo-$C_1$-$C_4$alkoxy, $C_1$-$C_4$alkoxy, phenyl, naphthyl and pyridyl, straight chain or branched $C_3$-$C_4$alkoxy which is substituted by at least one substituent selected from the group consisting of hydroxy, cyano, $SO_3H$, $NH_2$, carboxy, carbo-$C_1$-$C_4$alkoxy, $C_1$-$C_4$alkoxy, phenyl, naphthyl and pyridyl, halogen, $—SO_2CH_2CH_2SO_3H$, $NO_2$, COOH, $—COOC_1$-$C_4$alkyl, $NH_2$, $NHC_1$-$C_4$alkyl, wherein the alkyl group may be substituted by at least one substituent selected from the group consisting of OH, $NH_2$, $C_1$-$C_4$alkyl, CN and COOH, $N(C_1$-$C_4$alkyl$)C_1$-$C_4$alkyl, wherein the alkyl groups may independently of one another be substituted by at least one substituent selected from the group consisting of OH, $NH_2$, $C_1$-$C_4$alkyl, CN and COOH, NH-aryl, NH-aryl, wherein aryl is substituted by at least one substituent selected from the group consisting of hydroxy, cyano, $SO_3H$, $NH_2$, carboxy, carbo-$C_1$-$C_4$alkoxy, $C_1$-$C_4$alkyl and $C_1$-$C_4$alkoxy, or represents $NHCOC_1$-$C_4$alkyl or $NHCOOC_1$-$C_4$alkyl;

G represents the direct bond, —$COOC_1$-$C_4$alkylene, arylene; arylene which is substituted by at least one substituent selected from the group consisting of hydroxy, cyano, $NO_2$, $SO_3H$, $NH_2$, carboxy, carbo-$C_1$-$C_4$alkoxy, $C_1$-$C_4$alkoxy and $C_1$-$C_4$alkyl, $C_1$-$C_4$alkylene, $C_1$-$C_4$-alkylene substituted by at least one substituent selected from the group consisting of hydroxy, cyano, $NO_2$, $SO_3H$, $NH_2$, carboxy, carbo-$C_1$-$C_4$alkoxy, $C_1$-$C_4$alkoxy and $C_1$-$C_4$alkyl, or represents —CO-arylene;

n represents 0; 1; 2 or 3;

n' represents 0; 1 or 2; and each M independently of one another represents hydrogen; an alkali metal ion or an ammonium ion.

10. A composition according to claim 4, wherein D represents the substituent of a mono-azo dye of the partial formulae XIa, XIb, XIc or XId:

(XIa)

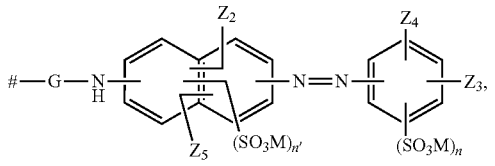

wherein # marks the point of attachment of the bridging group L;

$Z_2$ represents $C_1$-$C_2$-alkyl, $C_1$-$C_2$-alkyl which is substituted by at least one substituent selected from the group consisting of hydroxy, cyano, $SO_3H$, $NH_2$, carboxy, carbo-$C_1$-$C_2$alkoxy, $C_1$-$C_2$alkoxy, phenyl, naphthyl and pyridyl, $C_1$-$C_2$alkoxy, $C_1$-$C_2$alkoxy which is substituted by at least one substituent selected from the group consisting of hydroxy, cyano, $SO_3H$, $NH_2$, carboxy, carbo-$C_1$-$C_2$alkoxy, $C_1$-$C_2$alkyl, phenyl, naphthyl and pyridyl, or represents OH;

$Z_3$ represents hydrogen, $C_1$-$C_2$-alkyl, $C_1$-$C_2$-alkyl which is substituted by at least one substituent selected from the group consisting of hydroxy, cyano, $SO_3H$, $NH_2$, carboxy, carbo-$C_1$-$C_2$alkoxy, $C_1$-$C_2$alkoxy, phenyl, naphthyl and pyridyl, $C_1$-$C_2$alkoxy, $C_1$-$C_2$alkoxy which is substituted by at least one substituent selected from the group consisting of hydroxy, cyano, $SO_3H$, $NH_2$, carboxy, carbo-$C_1$-$C_2$alkoxy, $C_1$-$C_2$alkyl, phenyl, naphthyl and pyridyl, OH, $NO_2$, $NH_2$, $NHC_1$-$C_2$alkyl, wherein the alkyl group may be substituted by at least one substituent selected from the group consisting of OH, $NH_2$, $C_1$-$C_2$alkyl, CN and COOH, or represents $NHCOC_1$-$C_2$alkyl or $NHCOOC_1$-$C_2$alkyl;

$Z_4$ represents hydrogen, $C_1$-$C_2$-alkyl, $C_1$-$C_2$-alkyl which is substituted by at least one substituent selected from the group consisting of hydroxy, cyano, $SO_3H$, $NH_2$, carboxy, carbo-$C_1$-$C_2$alkoxy, $C_1$-$C_2$alkoxy, phenyl, naphthyl and pyridyl, $C_1$-$C_2$alkoxy, $C_1$-$C_2$alkoxy which is substituted by at least one substituent selected from the group consisting of hydroxy, cyano, $SO_3H$, $NH_2$, carboxy, carbo-$C_1$-$C_4$alkoxy, $C_1$-$C_4$alkyl, phenyl, naphthyl and pyridyl, OH, $NO_2$, $NH_2$, $NHC_1$-$C_2$alkyl, wherein the alkyl group may be substituted by at least one substituent selected from the group consisting of OH, $NH_2$, $C_1$-$C_2$alkyl, CN and COOH, or represents $NHCOC_1$-$C_2$alkyl or $NHCOOC_1$-$C_2$alkyl;

$Z_5$ represents hydrogen, $C_1$-$C_2$-alkyl, $C_1$-$C_2$-alkyl which is substituted by at least one substituent selected from the group consisting of hydroxy, cyano, $SO_3H$, $NH_2$, carboxy, carbo-$C_1$-$C_2$alkoxy, $C_1$-$C_2$alkoxy, phenyl, naphthyl and pyridyl;

G represents the direct bond, $COOC_1$-$C_2$alkylene, arylene, arylene which is substituted by at least one substituent selected from the group consisting of hydroxy, cyano, $NO_2$, $SO_3H$, $NH_2$, carboxy, carbo-$C_1$-$C_2$alkoxy, $C_1$-$C_2$alkoxy and $C_1$-$C_2$alkyl, $C_1$-$C_2$alkylene or $C_1$-$C_2$-alkylene which is substituted by at least one substituent selected from the group consisting of hydroxy, cyano, $NO_2$, $SO_3H$, $NH_2$, carboxy, carbo-$C_1$-$C_2$alkoxy, $C_1$-$C_2$alkoxy and $C_1$-$C_2$alkyl;

n represents 0, 1, 2 or 3;

n' represents 0, 1 or 2; and each M independently of one another represents hydrogen, $Na^+$ or $K^+$;

(XIb)

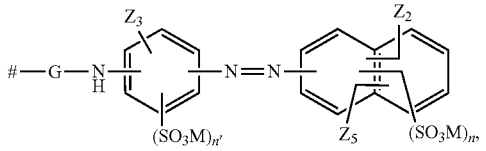

Wherein # marks the point of attachment of the bridging group L;

$Z_2$ represents $C_1$-$C_2$-alkyl, $C_1$-$C_2$-alkyl which is substituted by at least one substituent selected from the group consisting of hydroxy, cyano, $SO_3H$, $NH_2$, carboxy, carbo-$C_1$-$C_2$alkoxy, $C_1$-$C_2$alkoxy, phenyl, naphthyl and pyridyl, $C_1$-$C_2$alkoxy, $C_1$-$C_2$alkoxy which is substituted by at least one substituent selected from the group consisting of hydroxy, cyano, $SO_3H$, $NH_2$, carboxy, carbo-$C_1$-$C_2$alkoxy, $C_1$-$C_2$alkyl, phenyl, naphthyl and pyridyl or represents OH;

$Z_3$ is hydrogen, $C_1$-$C_2$-alkyl, $C_1$-$C_2$-alkyl which is substituted by at least one substituent selected from the group consisting of hydroxy, cyano, $SO_3H$, $NH_2$, carboxy, carbo-$C_1$-$C_2$alkoxy, $C_1$-$C_2$alkoxy, phenyl, naphthyl and pyridyl, $C_1$-$C_2$alkoxy, $C_1$-$C_2$alkoxy which is substituted by at least one substituent selected from the group consisting of hydroxy, cyano, $SO_3H$, $NH_2$, carboxy, carbo-$C_1$-$C_2$alkoxy, $C_1$-$C_2$alkyl, phenyl, naphthyl and pyridyl, OH, $NO_2$, $NH_2$, $NHC_1$-$C_2$alkyl, wherein the alkyl group may be substituted by at least one substituent selected from the group consisting of OH, $NH_2$, $C_1$-$C_2$alkyl, CN or COOH or represents $NHCOC_1$-$C_2$alkyl or $NHCOOC_1$-$C_2$alkyl;

$Z_5$ represents hydrogen, $C_1$-$C_2$-alkyl or $C_1$-$C_2$-alkyl which is substituted by at least one substituent selected from the group consisting of hydroxy, cyano, $SO_3H$, $NH_2$, carboxy, carbo-$C_1$-$C_2$alkoxy, $C_1$-$C_2$alkoxy, phenyl, naphthyl and pyridyl;

G represents the direct bond, $COOC_1$-$C_2$alkylene, arylene, arylene which is substituted by at least one substituent selected from the group consisting of hydroxy, cyano, $NO_2$, $SO_3H$, $NH_2$, carboxy, carbo-$C_1$-$C_2$alkoxy, $C_1$-$C_2$alkoxy and $C_1$-$C_2$alkyl, $C_1$-$C_2$alkylene or $C_1$-$C_2$-alkylene which is substituted by at least one substituent selected from the group consisting of hydroxy, cyano, $NO_2$, $SO_3H$, $NH_2$, carboxy, carbo-$C_1$-$C_2$alkoxy, $C_1$-$C_2$alkoxy and $C_1$-$C_2$alkyl;

n represents 0, 1, 2 or 3;

N' is 0, 1 or 2; and each M independently of one another represents hydrogen, $Na^+$ or $K^+$;

(XIc)

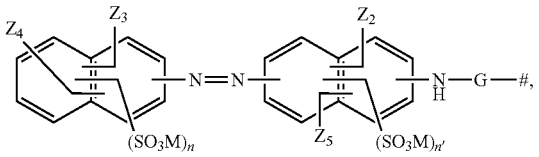

Wherein # marks the point of attachment of the bridging group L;

$Z_2$ represents hydrogen, hydroxy, $C_1$-$C_2$-alkyl, $C_1$-$C_2$-alkyl which is substituted by at least one substituent selected from the group consisting of hydroxy, cyano, $SO_3H$, $NH_2$, carboxy, carbo-$C_1$-$C_2$alkoxy, $C_1$-$C_2$alkoxy, phenyl, naphthyl and pyridyl, $C_1$-$C_2$alkoxy or $C_1$-$C_2$alkoxy which is substituted by at least one substituent selected from the group consisting of hydroxy, cyano, $SO_3H$, $NH_2$, carboxy, carbo-$C_1$-$C_4$alkoxy, $C_1$-$C_4$alkyl, phenyl, naphthyl and pyridyl, or represents OH or $NO_2$;

$Z_3$ represents hydrogen, $C_1$-$C_2$-alkyl, $C_1$-$C_2$-alkyl which is substituted by at least one substituent selected from the group consisting of hydroxy, cyano, $SO_3H$, $NH_2$, carboxy, carbo-$C_1$-$C_2$alkoxy, $C_1$-$C_2$alkoxy, phenyl, naphthyl and pyridyl, $C_1$-$C_2$alkoxy, $C_1$-$C_2$alkoxy which is substituted by at least one substituent selected from the group consisting of hydroxy, cyano, $SO_3H$, $NH_2$, carboxy, carbo-$C_1$-$C_2$alkoxy, $C_1$-$C_2$alkyl, phenyl, naphthyl and pyridyl, OH, $NO_2$, $NH_2$, $NHC_1$-$C_2$alkyl, wherein the alkyl group may be substituted by at least one substituent selected from the group consisting of OH, $NH_2$, $C_1$-$C_2$alkyl, CN and COOH, or represents $NHCOC_1$-$C_2$alkyl or $NHCOOC_1$-$C_2$alkyl;

$Z_4$ represents hydrogen, $C_1$-$C_2$-alkyl, $C_1$-$C_2$-alkyl which is substituted by at least one substituent selected from the group consisting of hydroxy, cyano, $SO_3H$, $NH_2$, carboxy, carbo-$C_1$-$C_2$alkoxy, $C_1$-$C_2$alkoxy, phenyl, naphthyl and pyridyl, $C_1$-$C_2$alkoxy or $C_1$-$C_2$alkoxy which is substituted by at least one substituent selected from the group consisting of hydroxy, cyano, $SO_3H$, $NH_2$, carboxy, carbo-$C_1$-$C_4$alkoxy, $C_1$-$C_4$alkyl, phenyl, naphthyl and pyridyl, OH, $NO_2$, $NH_2$, $NHC_1$-$C_2$alkyl, wherein the alkyl group may be substituted by at least one substituent selected from the group consisting of OH, $NH_2$, $C_1$-$C_2$alkyl, CN and COOH, or represents $NHCOC_1$-$C_2$alkyl or $NHCOOC_1$-$C_2$alkyl;

$Z_5$ represents hydrogen, $C_1$-$C_2$-alkyl, $C_1$-$C_2$-alkyl which is substituted by at least one substituent selected from the group consisting of hydroxy, cyano, $SO_3H$, $NH_2$, carboxy, carbo-$C_1$-$C_2$alkoxy, $C_1$-$C_2$alkoxy, phenyl, naphthyl and pyridyl, $C_1$-$C_2$alkoxy, $C_1$-$C_2$alkoxy which is substituted by at least one substituent selected from the group consisting of hydroxy, cyano, $SO_3H$, $NH_2$, carboxy, carbo-$C_1$-$C_4$alkoxy, $C_1$-$C_4$alkyl, phenyl, naphthyl and pyridyl, or represents $NO_2$;

G represents the direct bond, $COOC_1$-$C_2$alkylene, arylene, arylene which is substituted by at least one substituent selected from the group consisting of hydroxy, cyano, $NO_2$, $SO_3H$, $NH_2$, carboxy, carbo-$C_1$-$C_2$alkoxy, $C_1$-$C_2$alkoxy and $C_1$-$C_2$alkyl, $C_1$-$C_2$alkylene or $C_1$-$C_2$-alkylene which is substituted by at least one substituent selected from the group consisting of hydroxy, cyano, $NO_2$, $SO_3H$, $NH_2$, carboxy, carbo-$C_1$-$C_2$alkoxy, $C_1$-$C_2$alkoxy and $C_1$-$C_2$alkyl, n represents 0, 1, 2 or 3;

n' represents 0, 1 or 2; and each M independently of one another represents $Na^+$ or $K^+$;

(XId)

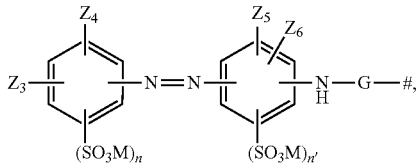

Wherein # marks the point of attachment of the bridging group L;

$Z_3$ represents hydrogen, $C_1$-$C_2$-alkyl, $C_1$-$C_2$-alkyl which is substituted by at least one substituent selected from the group consisting of hydroxy, cyano, $SO_3H$, $NH_2$, carboxy, carbo-$C_1$-$C_2$alkoxy, $C_1$-$C_2$alkoxy, phenyl, naphthyl and pyridyl, $C_1$-$C_2$alkoxy, $C_1$-$C_2$alkoxy which is substituted by at least one substituent selected from the group consisting of hydroxy, cyano, $SO_3H$, $NH_2$, carboxy, carbo-$C_1$-$C_4$alkoxy, $C_1$-$C_4$alkyl, phenyl, naphthyl and pyridyl, or represents $SO_2CH_2CH_2SO_3H$ or $NO_2$;

$Z_4$ represents $C_1$-$C_2$-alkyl, $C_1$-$C_2$-alkyl which is substituted by at least one substituent selected from the group consisting of hydroxy, cyano, $SO_3H$, $NH_2$, carboxy, carbo-$C_1$-$C_2$alkoxy, $C_1$-$C_2$alkoxy, phenyl, naphthyl and pyridyl, $C_1$-$C_2$alkoxy, $C_1$-$C_2$alkoxy which is substituted by at least one substituent selected from the group consisting of hydroxy, cyano, $SO_3H$, $NH_2$, carboxy, carbo-$C_1$-$C_4$alkoxy, $C_1$-$C_4$alkyl, phenyl, naphthyl and pyridyl, OH, or represents $SO_2CH_2CH_2SO_3H$, or $NO_2$;

$Z_5$ represents hydrogen, $C_1$-$C_2$-alkyl, $C_1$-$C_2$-alkyl which is substituted by at least one substituent selected from the group consisting of hydroxy, cyano, $SO_3H$, $NH_2$, carboxy, carbo-$C_1$-$C_2$alkoxy, $C_1$-$C_2$alkoxy, phenyl, naphthyl and pyridyl, $C_1$-$C_2$alkoxy, $C_1$-$C_2$alkoxy which is substituted by at least one substituent selected from the group consisting of hydroxy, cyano, $SO_3H$, $NH_2$, carboxy, carbo-$C_1$-$C_4$alkoxy, $C_1$-$C_4$alkyl, phenyl, naphthyl and pyridyl, OH, $NO_2$, $NH_2$, $NHC_1$-$C_2$alkyl, wherein the alkyl group may be substituted by at least one substituent selected from the group consisting of OH, $NH_2$, $C_1$-$C_2$alkyl, CN and COOH, or represents $NHCOC_1$-$C_2$alkyl or $NHCOOC_1$-$C_2$alkyl;

$Z_6$ represents $C_1$-$C_2$-alkyl, $C_1$-$C_2$-alkyl which is substituted by at least one substituent selected from the group consisting of hydroxy, cyano, $SO_3H$, $NH_2$, carboxy, carbo-$C_1$-$C_2$alkoxy, $C_1$-$C_2$alkoxy, phenyl, naphthyl and pyridyl, $C_1$-$C_2$alkoxy, $C_1$-$C_2$alkoxy which is substituted by at least one substituent selected from the group consisting of hydroxy, cyano, $SO_3H$, $NH_2$, carboxy, carbo-$C_1$-$C_4$alkoxy, $C_1$-$C_4$alkyl, phenyl, naphthyl and pyridyl, or represents $NO_2$;

G represents the direct bond, $COOC_1$-$C_2$alkylene, arylene, arylene which is substituted by at least one substituent selected from the group consisting of hydroxy, cyano, $NO_2$, $SO_3H$, $NH_2$, carboxy, carbo-$C_1$-$C_2$alkoxy, $C_1$-$C_2$alkoxy and $C_1$-$C_2$alkyl, $C_1$-$C_2$alkylene or $C_1$-$C_2$-alkylene which is substituted by at least one substituent selected from the group consisting of hydroxy, cyano, $NO_2$, $SO_3H$, $NH_2$, carboxy, carbo-$C_1$-$C_2$alkoxy, $C_1$-$C_2$alkoxy and $C_1$-$C_2$alkyl;

n represents 0, 1, 2 or 3;

n' represents 0, 1 or 2; and each M independently of one another represents hydrogen, $Na^+$ or $K^+$.

11. A composition according to claim 4, wherein D is selected from the group consisting of compounds, wherein the partial formulae 10, 11, 12, 13 and 14:

(10)

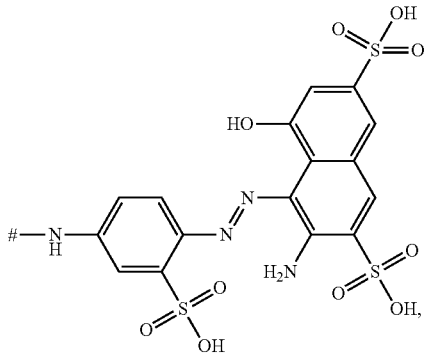

(11)

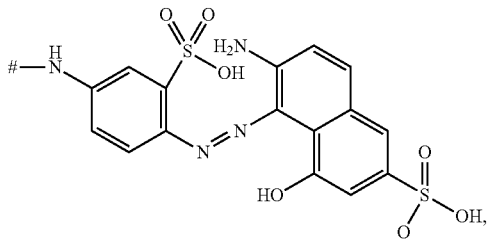

-continued (12)

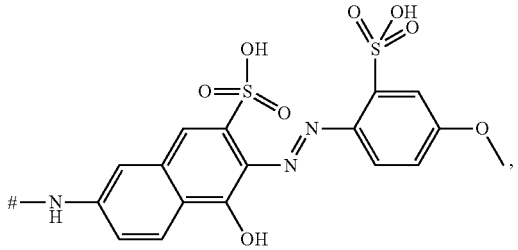

(13)

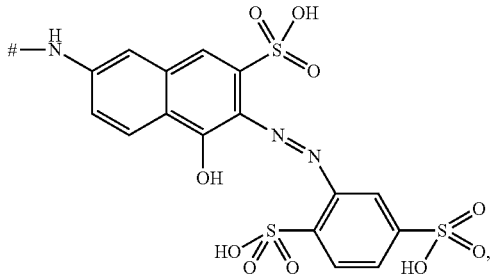

(14)

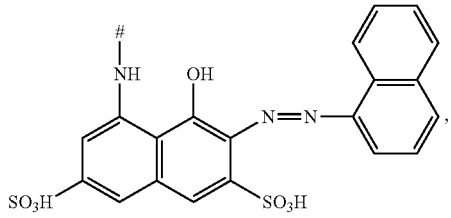

are present and wherein # marks the point of attachment of the bridging group L.

12. A composition according to claim 2, wherein the oil component c) is a triglyceride oil.

13. A composition according to claim 2, wherein the powdering agent component d) is starch or modified starch.

14. A composition according to claim 2, wherein the further additives of component e) are selected from the group consisting of anionic dispersants, disintegrants, fillers, water-insoluble or water-soluble dyes or pigments; optical brighteners, zeolites, talcum, powdered cellulose, fibrous cellulose, microcrystalline cellulose, starch, dextrin, kaolin, $TiO_2$, $SiO_2$ and magnesium trisilicate.

15. A composition according to claim 1, wherein the composition comprises a detersive surfactant, wherein the detersive surfactant comprises:

(i) alkoxylated alkyl sulphate anionic detersive surfactant having an average degree of alkoxylation of from 0.5 to 5; and/or (ii) predominantly $C_{12}$ alkyl sulphate anionic detersive surfactant;

(iii) less than 25% non-ionic detersive surfactant.

16. A composition according to claim 1, wherein the composition comprises a clay and soil removal/anti-redeposition agent selected from the group consisting of:

(a) random graft co-polymers comprising:

(i) hydrophilic backbone comprising polyethylene glycol; and (ii) hydrophobic side chain(s) selected from the group consisting of: $C_4$-$C_{25}$ alkyl group, polypropylene, polybutylene, vinyl ester of a saturated $C_1$-$C_6$ monocarboxylic acid, $C_1$-$C_6$ alkyl ester of acrylic or methacrylic acid, and mixtures thereof;

(b) cellulosic polymers having a degree of substitution (DS) of from 0.01 to 0.99 and a degree of blockiness (DB) such that either DS+DB is of at least 1.00 or $DB+2DS-DS^2$ is at least 1.20;

(c) co-polymers comprising:

(i) from 50 to less than 98 wt % structural units derived from one or more monomers comprising carboxyl groups;

(ii) from 1 to less than 49 wt % structural units derived from one or more monomers comprising sulfonate moieties; and (iii) from 1 to 49 wt % structural units derived from one or more types of monomers selected from ether bond-containing monomers represented by formulas (I) and (II):

formula (I)

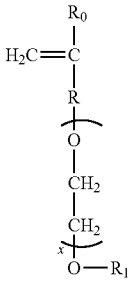

wherein in formula (I), $R_0$ represents a hydrogen atom or $CH_3$ group, R represents a $CH_2$ group, $CH_2CH_2$ group or single bond, X represents a number 0-5 provided X represents a number 1-5 when R is a single bond, and $R_1$ is a hydrogen atom or $C_1$ to $C_{20}$ organic group;

formula (II)

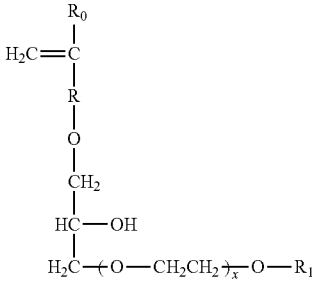

in formula (II), $R_o$ represents a hydrogen atom or $CH_3$ group, R represents a $CH_2$ group, $CH_2CH_2$ group or single bond, X represents a number 0-5, and $R_1$ is a hydrogen atom or $C_1$ to $C_{20}$ organic group;

(d) polyester soil release polymers having a structure according to one of the following structures (I), (II) or (III):

(I) $—[(OCHR^1—CHR^2)_a—O—OC—Ar—CO-]_a$ (II) $—[(OCHR^3—CHR^4)_b—O—OC\text{-}sAr—CO—]_e$ (III) $—[(OCHR^5—CHR^6)_c—OR^7]_f$ wherein:

a, b and c are from 1 to 200;

d, e and f are from 1 to 50;

Ar is a 1,4-substituted phenylene;

sAr is 1,3-substituted phenylene substituted in position 5 with $SO_3Me$;

Me is Li, K, Mg/2, Ca/2, Al/3, ammonium, mono-, di-, tri-, or tetraalkylammonium wherein the alkyl groups are $C_1$-$C_{18}$ alkyl or $C_2$-$C_{10}$ hydroxyalkyl, or any mixture thereof;

$R^1$, $R^2$, $R^3$, $R^4$, $R^5$ and $R^6$ are independently selected from H or $C_1$-$C_8$ n- or iso-alkyl; and $R^7$ is a linear or branched $C_1$-$C_{18}$ alkyl, or a linear or branched $C_2$-$C_{30}$ alkenyl, or a cycloalkyl group with 5 to 9 carbon atoms, or a $C_8$-$C_{30}$ aryl group, or a $C_6$-$C_{30}$ arylalkyl group; and (e) any combination thereof.

17. A composition according to claim 1, wherein the composition comprises an oxaziridinium-based bleach catalyst having the formula:

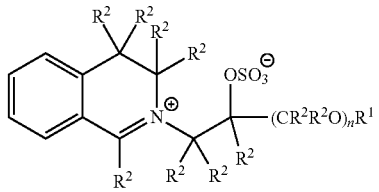

wherein: $R^1$ is selected from the group consisting of: H, a branched alkyl group containing from 3 to 24 carbons, and a linear alkyl group containing from 1 to 24 carbons; $R^2$ is independently selected from the group consisting of: H, a branched alkyl group comprising from 3 to 12 carbons, and a linear alkyl group comprising from 1 to 12 carbons; and n is an integer from 0 to 1.

18. A composition according to claim 1, wherein the composition comprises C.I. fluorescent brightener 260 having the following structure:

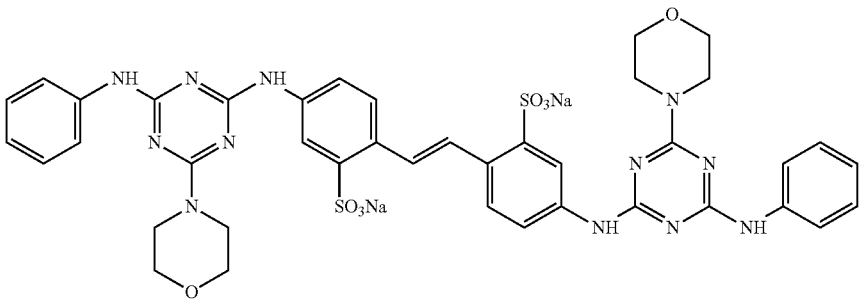

wherein the C.I. fluorescent brightener 260 is either:

predominantly in alpha-crystalline form; or predominantly in beta-crystalline form and having a weight average primary particle size of from 3 to 30 micrometers.

19. A composition according to claim 1, wherein the composition comprises an enzyme selected from the group consisting of:

(a) a variant of *thermomyces lanuginosa* lipase having >90% identity with the wild type amino acid and comprises substitution(s) at T231 and/or N233;

(b) a cleaning cellulase belonging to Glycosyl Hydrolase family 45;

(c) a variant of AA560 alpha amylase endogenous to *Bacillus* sp. DSM 12649 having:

(i) mutations at one or more of positions 9, 26, 149, 182, 186, 202, 257, 295, 299, 323, 339 and 345; and (ii) one or more substitutions and/or deletions in the following positions: 118, 183, 184, 195, 320 and 458; and (d) any combination thereof.

20. A composition according to claim 1, wherein the composition is substantially free of zeolite builder, and wherein the composition is substantially free of phosphate builder.

* * * * *

UNITED STATES PATENT AND TRADEMARK OFFICE

CERTIFICATE OF CORRECTION

PATENT NO. : 8,883,703 B2
APPLICATION NO. : 13/870136
DATED : November 11, 2014
INVENTOR(S) : Stenger et al.

It is certified that error appears in the above-identified patent and that said Letters Patent is hereby corrected as shown below:

IN THE CLAIMS:

Column 56
Line 8, delete "–O-OC-Ar-CO-]$_a$" and insert -- -O-OC-Ar-CO-]$_d$ --.

Column 56
Line 23, delete "$C_1$-$C_8$" and insert -- $C_1$-$C_{18}$ --.

Signed and Sealed this
Seventeenth Day of March, 2015

Michelle K. Lee

Michelle K. Lee
*Director of the United States Patent and Trademark Office*